US007449267B2

(12) United States Patent
Itami et al.

(10) Patent No.: US 7,449,267 B2
(45) Date of Patent: Nov. 11, 2008

(54) IMAGE FORMING METHOD

(75) Inventors: Akihiko Itami, Hachioji (JP); Masao Asano, Tokyo (JP); Hiroshi Yamazaki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 444 days.

(21) Appl. No.: 11/216,988

(22) Filed: Aug. 31, 2005

(65) Prior Publication Data

US 2006/0115754 A1 Jun. 1, 2006

(30) Foreign Application Priority Data

Nov. 26, 2004 (JP) ..... 2004-342142

(51) Int. Cl.
*G03G 15/01* (2006.01)
*G03G 15/06* (2006.01)

(52) U.S. Cl. ..... 430/45.54; 430/46.1; 430/120.1

(58) Field of Classification Search ..... 430/45.54, 430/120, 46, 46.1, 120.1
See application file for complete search history.

(56) References Cited

U.S. PATENT DOCUMENTS 5,679,488 A * 10/1997 Itami et al. ..... 430/58.05
7,081,234 B1 7/2006 Qi et al.
2002/0028091 A1* 3/2002 Hibino ..... 399/267
2006/0093931 A1 5/2006 Qi et al.

FOREIGN PATENT DOCUMENTS

| | | |
|---|---|---|
| JP | 08-262752 | 10/1996 |
| JP | 2001-125435 | 5/2001 |
| JP | 2002-244336 | 8/2002 |
| JP | 2002287401 | * 10/2002 |
| JP | 2003-029444 | 1/2003 |

* cited by examiner

*Primary Examiner*—John L Goodrow
(74) *Attorney, Agent, or Firm*—Lucas & Mercanti, LLP

(57) ABSTRACT

An electrophotographic image forming method is disclosed. The method contains steps of forming an electrostatic latent image on an organic photoreceptor, and developing the electrostatic latent image by a developer containing toner to form a toner image on the photoreceptor. In this method the photoreceptor contains inorganic particles in a surface layer, the toner has circle equivalent diameter d of 3.0 to 8.0 μm viewed from a direction which maximizes the projective area of toner particles, the toner has a flatness ratio d/t of 2.0 to 5.0, wherein d is circle equivalent diameter and t is average thickness of toner particles, and the electrostatic latent image is developed in such a manner that the developing sleeve is rotated in the opposite direction to the photoreceptor.

20 Claims, 4 Drawing Sheets

IMAGE FORMING METHOD

BACKGROUND OF THE INVENTION

1. Field of the Invention

This invention relates to a toner for developing a static latent image and an image forming method.

2. Description of Related Art

Most of electrophotographic photoreceptors have been shifted from inorganic photoreceptors to organic photoreceptors, the latter of which exhibit advantages such as minimal pollution and ease of production, and the above organic photoreceptors (hereinafter also referred simply to as photoreceptors), employing various materials, have been developed.

In recent years, function-separating type photoreceptors in which a charge generating function and a charge transport function are performed employing different materials have become the main current. For example, widely employed are photoreceptors which are composed of a conductive support having thereon a surface layer incorporating inorganic particles (refer to Patent Document 1).

Further, when attention is paid to electrophotographic processes, latent image forming systems are divided mainly into analog image formation employing halogen lamps as a light source, and digital system image formation employing LEDs and lasers as a light source. Recently, digital system latent image forming systems are increasingly becoming the mainstream due to application to hard copy printers of personal computers, as well as ease of image processing and ease of development to composite devices in conventional copiers.

Further, in the image forming method employing a digital system, the frequency of preparation of original print images increases, whereby demand for higher image quality has been increased. In order to enhance the image quality of the above electrophotographic images, a technique has been developed in which a highly detailed latent image is formed on an organic photoreceptor employing an exposure light source of a small spot diameter, and the resulting minute dot images are converted to a toner image.

Namely, known as development methods of latent images on an organic photoreceptor are a development system (hereinafter referred to as a parallel development system) in which a developing sleeve facing the organic photoreceptor is advanced parallel to the advancing direction of the organic photoreceptor in the development region, and a development method (hereinafter referred to as a counter-development system) in which the developing sleeve is advanced in the opposite direction (refer to Patent Document 2). However, when high density dot images are formed, neither have completely overcome the above drawbacks.

In the development system in which a developing sleeve facing the photoreceptor is advanced parallel to the advancing direction of the photoreceptor, developability of the periphery of images suffer, resulting in tendency of insufficient density, whereby high contrast photographic images tend to suffer from the degradation in image quality.

On the other hand, a development system, in which the developing sleeve is advanced in the opposite direction, enables the formation of high density dot mages due to high developability, but fogging and insufficient density at the leading edge tend to occur.

It has been found that such problematic phenomena are not minimized only by improvement of developers and are enhanced or minimized depending on characteristics of the photoreceptors.

Further, it is assumed that the above phenomena relate to the contrast of electrostatic latent images formed on an organic photoreceptor and the formation of reversely charged toner due to friction between the organic photoreceptor and the developer.

Namely, in the counter-development system, a reversely charged toner tends to form due to contact friction with the photoreceptor. As a result, fogging and toner scattering tend to occur and a decrease in density of the leading edge portion also tends to occur, whereby it is not possible to reproduce a highly detailed electrostatic latent image as a toner image. Heretofore, it has been proposed to use a polymerization toner of which particle size distribution is narrowed in a development means (refer to Patent Document 3). However, it was found that a toner exhibiting the proposed size distribution, when employed in the counter-development system, was not capable of sufficiently retarding the formation of reversely charged toner, whereby it was not possible to reproduce highly detailed electrostatic latent image as a toner image.

Further, for preparing high density images by increasing the shielding effect of toner, a toner is known in which the shape of particles is flattened (refer to Patent Document 4). However, since the above toner composed of flattened particles easily adheres to a carrier to result in tendency of degraded developability, it has not been possible to prepare high density images.

(Patent Document 1) Japanese Patent Publication for Public Inspection (hereinafter referred to as JP-A) No. 8-262752

(Patent Document 2) JP-A No. 2001-125435

(Patent Document 3) JP-A No. 2002-244336

(Patent Document 4) JP-A No. 2003-29444

SUMMARY

An object of the present invention is to provide a useful image forming method.

Another object can be to obtain an image forming method which can stably forms highly detailed digital images upon overcoming problems which tend to occur in the counter-development system as described above, and in more detail, to provide an image forming method and an image forming apparatus capable of producing electrophotographic images of high image density and excellent color reproduction by minimizing fog, toner scattering, and formation of non-uniform images due to a decrease in density of the leading edge portion, which tend to result in the counter-development system.

An embodiment is an image forming method which comprises;

developing an electrostatic latent image on an organic photoreceptor by a developer on a developing sleeve to form a toner image on the photoreceptor, the developer comprising a toner, wherein the photoreceptor contains inorganic particles in a surface layer, the toner has circle equivalent diameter d of 3.0 to 8.0 μm viewed from a direction which maximizes the projective area of toner particles, the toner is a flat toner having a flatness ratio d/t of 2.0 to 5.0, wherein d is circle equivalent diameter and t is average thickness of toner particles, and the electrostatic latent image is developed in such a manner that the developing sleeve is rotated in opposite direction with respect to rotation direction of the photoreceptor.

DETAILED DESCRIPTION

Figure 1:
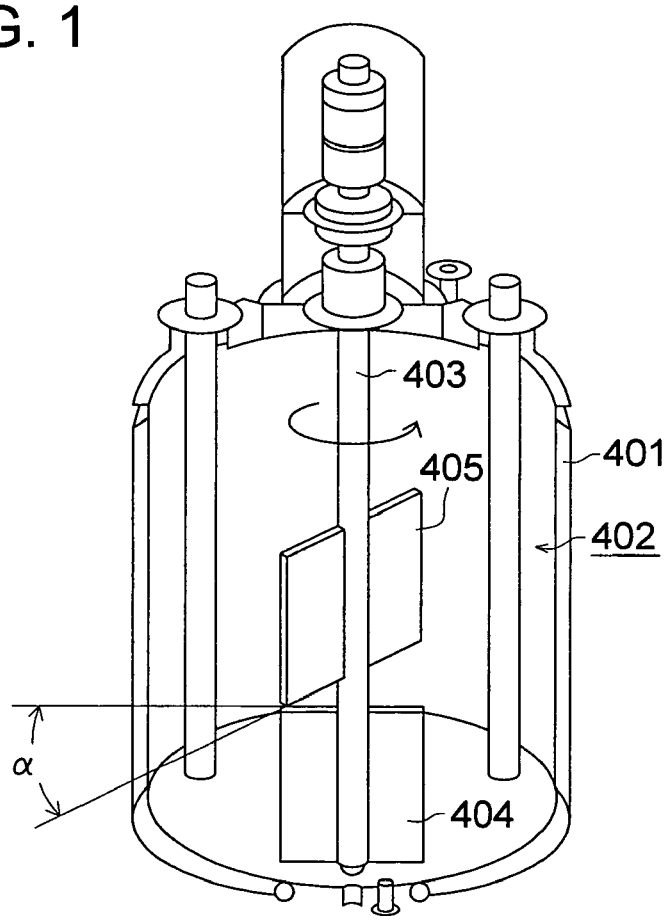
FIG. 1 is a perspective view showing an example of a stirring tank fitted with stirring blades.

It was discovered that it was effective to simultaneously employ a flat toner and an organic photoreceptor having a surface layer incorporating inorganic particles to obtain excellent results.

Embodiments are described.

An image forming method in which an electrostatic latent image is formed on an organic photoreceptor and the electrostatic latent image is visualized by contacting a developer on a developing sleeve with said organic photoreceptor, wherein the surface layer of the organic photoreceptor incorporates inorganic particles, toner contained in the developer has circle equivalent diameter d in the range of 3.0-8.0 μm when viewed from the direction which maximizes the projective area of toner particles, toner has a ratio (d/t or flatness) of d to average thickness t of toner particles in the range of 2.0-5.0, and the electrostatic latent image is visualized as a toner image in such a manner that the developing sleeve is rotated in the opposite direction with respect to the rotation direction of the organic photoreceptor.

An image forming method in which an electrostatic latent image is formed on an organic photoreceptor, a plurality of image forming units is arranged which has a development device in which a developing sleeve carrying a developer incorporating toner, the developer is brought into contact with the organic photoreceptor to visualize the electrostatic latent image into a toner image, and a transfer device which transfers the toner image formed on the organic photoreceptor to a transfer medium, and each of the color toner images is formed on the organic photoreceptor employing toner, the color of which differs among the plurality of image forming units, and a color image is formed by transferring each of the above color toner images on the organic photoreceptor to a transfer medium, wherein the surface layer of the organic photoreceptor incorporates inorganic particles, circle equivalent diameter d of the toner is 3.0-8.0 μm when viewed from the direction which maximizes the projective area of toner particles, toner has a ratio (d/t or flatness) of d to average thickness t of toner particles of 2.0-5.0, and the above electrostatic latent image is visualized as a toner image in such a manner that the developing sleeve is rotated in the opposite direction with respect to the rotation direction of the organic photoreceptor.

By employing the above image forming method and image forming apparatus, it is possible to minimize fog formation and insufficient density at the leading edge portion which tend to occur in the counter-development system, whereby it is possible to provide electrophotographic images exhibiting excellent color reproduction.

In the above image forming method, an electrostatic latent image is formed on an organic photoreceptor, and the resulting electrostatic latent image is visualized as a toner image by bringing a developer on a developing sleeve into contact with the organic photoreceptor. The developer contains toner having circle equivalent diameter d of 3.0-8.0 μm, when viewed from the direction which maximizes the projective area of toner particles, and a ratio (d/t or flatness) of d to average thickness t of toner particles of 2.0-5.0. The electrostatic latent image is visualized as a toner image in such a manner that the developing sleeve is rotated in the opposite direction with respect to the rotation direction of the organic photoreceptor.

In the above image forming method, an electrostatic latent image is formed on an organic photoreceptor, a plurality of image forming units is arranged which has a development device in which a developing sleeve carrying a developer incorporating toner is brought into contact with an organic photoreceptor to visualize an electrostatic latent image into a toner image, and a transfer device which transfers the above toner image formed on the above organic photoreceptor to a transfer medium, and each of the color toner images is formed on the organic photoreceptor employing a toner, the color of which differs among a plurality of image forming units, and a color image is formed by transferring each of the above color toner images on the organic photoreceptor onto a transfer medium. The surface layer of the organic photoreceptor incorporates inorganic particles. The toner has circle equivalent diameter d of 3.0-8.0 μm, when viewed from the direction which maximizes the projective area of toner particles, and a ratio (d/t or flatness) of d to average thickness t of toner particles of 2.0-5.0. The above electrostatic latent image is visualized as a toner image in such a manner that the above developing sleeve is rotated in the opposite direction with respect to the rotation of the above organic photoreceptor.

It is possible to minimize formation of fog and insufficient density of the leading edge portion which tend to occur in a counter-development system, whereby it is possible to provide high quality digital images or color images.

The toner having flat toner particles is called as flat toner. The flat toner is preferable to the above method. Preferred as a flat toner is a polymerization toner which is produced employing a polymerization method. In the case of a pulverization method, thermal treatments, such as spray drying are required. As used herein, "polymerization toner" refers to the toner which is prepared in such a manner that binder resins for toner are formed and the shape of toner particles is formed via polymerization of raw material monomers of binder resins, and if desired the following chemical treatments, and more specifically refers to the toner which is formed via a polymerization reaction such as suspension polymerization or emulsion polymerization and if desired, the following fusion process applied to particles.

It is possible to produce the flat toner in such a manner that the secondary particles, prepared by salting out/fusing resinous particles at a number average diameter of the primary particles of 10-500 nm, are subjected to a flattening treatment by circulating within a narrow pressurized channel while heated.

Circle equivalent diameter d is arithmetic mean particle diameter which is obtained as follows. The toner particles are viewed from the direction which maximizes the projective area of each of toner particles. The diameters of each toner particles are obtained by calculating circle equivalent area from maximum projective area. Each value of diameters is added and the added value is divided by the number of toner particles which are used to obtain the diameters. Circle equivalent diameter d is preferably 3.0-8.0 μm, but is more preferably 3.5-7.0 μm. By controlling d to this range, it is possible to minimize the formation of reversibly charged toner particles, whereby it is possible to retard toner scattering, as well as a decrease in the density of the leading edge portion, and image density.

In regard to the flat toner, the ratio (d/t, or flatness) of circle equivalent diameter d when the particles are viewed from the direction which maximizes the projective area of the particle to average thickness t of toner particles of the flat toner, is commonly 2.0-5.0, but is preferably 2.2-4.5.

When the flat toner, described above, is employed, in cases in which color images (at a printed area ratio of 25 percent) are formed, high density images are prepared at a markedly smaller consumption of toner of at most 40 mg per A4 print, and commonly 10-30 mg.

By satisfying the above flatness, retarded are the generation of reversely charged toner due to contact friction with the photoreceptor, a decrease in image density, and a decrease in density of the leading edge portion. It is also possible to retard toner scattering due to improved adhesion properties to the carriers.

When development is performed employing the above flat toner and an image is formed on an image forming body (being a photoreceptor), the flat toner on the image forming body is capable of adhering to the image forming body, directing the flat portion of toner particles toward the image forming body while further forming the layer. When the flat toner on the image forming body is transferred onto an intermediate transfer body or a transfer material, or when the flat toner on the intermediate transfer body is transferred onto a transfer material, layer forming adhesion of the flat toner is performed while directing the flat portion of toner particles toward the intermediate transfer body or the transfer material.

The surface of flat toner-particles is almost uniformly charged, and Coulomb force between the image forming body and the flat portion of flat toner particles becomes stronger than that between the image forming body and the edge portion of the flat toner particles. As a result, it is assumed that the flat portion adheres to the transfer body. As noted above, it is assumed that flat toner particles are aligned in line side by side while putting the edge on its side on the intermediate transfer material or transfer material, whereby the flat surface tends to pile up to form a layer, and a toner image is maintained without any changes during relocation.

(Determination of Thickness and Diameter of Flat Toner Particles)

Figure 7:
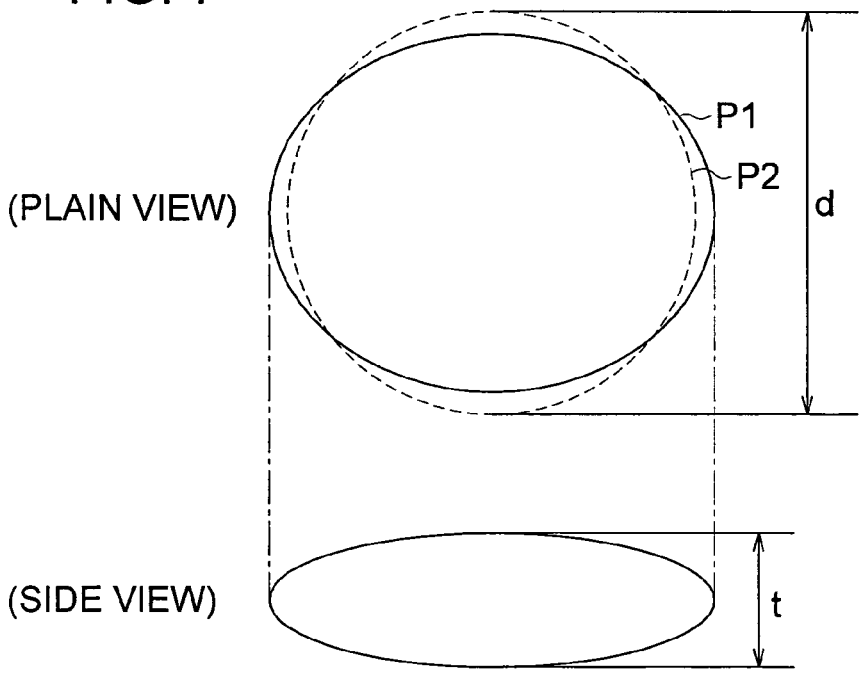
FIG. 7 is a schematic view showing an example of the flat toner particle according to the present invention.

The flat toner contains, preferably is composed of tabular particles. The shape may be elliptical or triangle, but tends to become elliptical when the flattening treatment, described below, is performed. FIG. 7 is a schematic view showing an example of a flat toner particle. Circle equivalent diameter d of a toner particle is described with reference to FIG. 7. FIG. 7 shows a top view and a side view of a flat toner particle. In FIG. 7, P1 represents the shape viewed from the direction which maximizes the protective area of a flat toner particle, while P2 represents the circle which has the same area as the projective area. Circle equivalent diameter d of the toner particle represents the diameter (being the circle equivalent diameter) of above circle P2, while t of the toner particle represents the maximum thickness viewed from the perpendicular to the projective direction of the above toner particle.

The projective area and thickness of flat toner particles are determined as follows. Thirty randomly selected toner particles are measured employing an ultra-deep color 3D shape measuring microscope VK-9500 (Keyence Corporation), and the circle equivalent diameter and thickness (being maximum height) of each toner particle, as shown in FIG. 7, are calculated. The arithmetic mean of each of these values is designated as circle equivalent diameter d or thickness t.

It is possible to prepare flat toner particles employing a polymerization method. Secondary particles are prepared by salting-out/fusing resinous particles at a number average diameter of the primary particles of 10-500 nm, which are prepared employing a suspension polymerization method or an emulsion polymerization method. Thereafter, organic solvents and polymerization catalysts are added, and the resulting mixture undergoes polymerization. The reaction solution in which polymerization is performed to a ratio of 80 percent is circulated through a pressurized narrow channel while heated so that the particles are flattened in shape. Thereafter, polymerization is completed by further adding polymerization catalysts, whereby it is possible to produce flat toner particles.

As used herein, "salting-out/fusion" means that minute resinous particles, prepared employing a polymerization method, are salted out employing coagulants and excess dispersing agents and surface active agents are removed, while simultaneously the size of resinous particles are controlled utilizing fusion while heated.

A flattening treatment may be performed after 100 percent completion of the polymerization. However, it is preferable to perform the flattening treatment in a state in which the polymerization is performed 80 percent since the shape becomes more uniform.

It is possible to perform the salting-out/fusion employing resinous particles of a number average diameter of primary particles of 10-500 nm, which are prepared employing a method in which resinous particles are blended with releasing agents and colorants, which are necessary for constituting toner, or a method in which toner constituting components such as releasing agents or colorants are dispersed into monomers and the resulting mixture undergoes polymerization.

Namely, various types of constituting materials such as colorants, and if desired releasing agents, charge control agents, further polymerization initiators are added to the polymerizable monomers, and the above materials are dissolved or dispersed in the polymerizable monomers employing any of a homogenizer, a sand mill, a sand grinder, or an ultrasonic homogenizer. A liquid composition, in which the above various types of constituting materials are dissolved or dispersed, is dispersed in a water based solvent, incorporating dispersion stabilizers, in the form of oil droplets of the desired size. Thereafter, the resulting dispersion is charged into a reaction apparatus equipped with a stirring mechanism fitted with stirring blades, and polymerization reaction is allowed to proceed 80 percent while heated. Thereafter, in a heated state, the reaction product is circulated through a narrow pressurized channel so that the particles are flattened. Thereafter, the polymerization is allowed to further proceed until 100 percent completion. After completion of polymerization, the dispersion stabilizers are removed, and filtration, washing, and drying are performed, whereby it is possible to produce a flat toner.

FIG. 1 is a perspective view and a cross-sectional view, of the reaction apparatus described above, respectively. In the reaction apparatus illustrated in FIG. 1, rotating shaft 403 is installed vertically at the center in vertical type cylindrical stirring tank 402 of which exterior circumference is equipped with a heat exchange jacket 401, and said rotating shaft 403 is provided with lower level stirring blades 404 installed near the bottom surface of said stirring tank 402 and upper level stirring blade 405. The upper level stirring blades 405 are arranged with respect to the lower level stirring blade so as to have a crossed axis angle α advanced in the rotation direction. When the toner of the presents invention is prepared, said crossed axis angle α is preferably less than 90 degrees. The lower limit of said crossed axis angle α is not particularly limited, but it is preferably at least about 5 degrees, and is more preferably at least 10 degrees. Incidentally, when stirring blades are constituted at three levels, the crossed axis angle between adjacent blades is preferably less than 90 degrees.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy)triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

Preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

The flat toner is comprised of at least resin and colorant. However, if desired, said toner may be comprised of releasing agent, which is fixability improving agent, charge control agent, and the like.

Colorants such as carbon black, magnetic materials, dyes, pigments may be used.

Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like.

Employed as charge control agents may also be various types of those which are known in the art and can be dispersed in water. Specifically listed are nigrosine dyes, metal salts of naphthenic acid or higher fatty acids, alkoxylated amines, quaternary ammonium salts, azo based metal complexes, salicylic acid metal salts or metal complexes thereof.

It is preferable that the number average primary particle diameter of particles of said charge control agents as well as said fixability improving agents is adjusted to about 10 to about 500 nm in the dispersed state.

The flat toner exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

It is possible to flatten the secondary particles, which have been subjected to salting-out/fusion, employing an annular type continuous wet stirring mill, a piston type high pressure homogenizer or an in-line screw pump.

Figure 2:
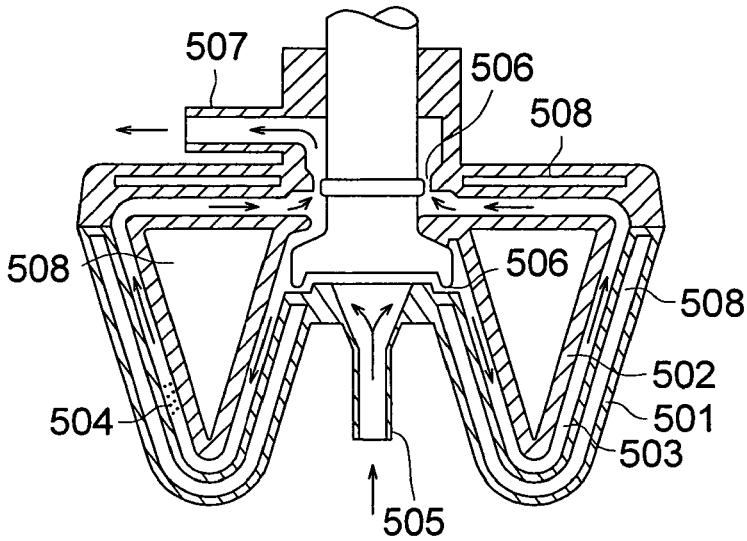
FIG. 2 is a sectional view of an example of the main portion of an annular type continuous wet stirring mill.

FIG. 2 is a sectional view showing an example of the main section of an annular type continuous wet stirring mill. The above annular type continuous wet stirring mill is one type mill which is conventionally known. In annular type (a ring-shaped) stator 501, the section of which is triangle, rotor 502 in the almost same shape rotates, and media 504 are filled in a narrow space or crushing zone 503 between above stator 501 and rotor 502. Subsequently, impact force is applied to a liquid composition incorporating secondary particles which have been polymerized 80 percent, which is fed to the mill, whereby the secondary particles are flattened. The liquid composition circulates from feeding inlet 505 of the mill through crushing zone 503, of W-type cross-section, employing a pump, is separated from media 504 at cap separator 506 in the upper portion, and discharged from outlet 507. Further, the temperature of the liquid composition during the flattening treatment is controlled by circulating heated water 508 between the stator and rotor. Media 504 successively moves through the W-type crushing zone and is re-circulated upon returning to the inlet. Particles are subjected to application of pressure from the wall of the crushing zone or media by circulating through the narrow pressurized channel. Commonly employed as the media are zircon, glass, or steel particles at a diameter of 0.5-3 mm.

The temperature during the flattening treatment of the liquid composition incorporating secondary particles, employing the above annular type continuous stirring mill, is preferably from −5 to +40° C. which is the glass transition point (Tg) of the resins used in the secondary particles, is more preferably from 0 to +30° C., but is most preferably from +10 to +30° C. When the treatment is performed at temperature at least 5° C. lower than the glass transition point, polymer particles are crushed and it becomes difficult to achieve flattening. On the other hand, when the treatment is performed at least 40° C. higher than the glass transition point, secondary particles are mutually fused to result in aggregation and in addition, flattened polymer particles return to the spherical state due to surface tension. Consequently, neither case is not preferred.

(Developer)

The toner of the present invention may be employed as either a single component developer by incorporating, for example, a magnetic material in a toner particle or a two-component developer by mixing with a carrier.

It is used as a non-magnetic single component developer as itself or a magnetic single component developer in combination with magnetic particles having particle size of 0.1-0.5 μm.

Further, the toner is blended with a carrier, and can be employed as a two-component developer. In such case, employed as magnetic particles of the carrier are conventional materials, known in the art, such as iron, ferrite, magnetite, and the like, as well as alloys of such metal with other metals such as aluminum, lead, and the like. Of these, ferrite is specifically preferred. Said magnetic particles preferably have a median particle diameter (d50) in volume distribution of 15 to 100 μm, and more preferably have one between 25 to 80 μm. The median diameter (d50) of said carrier can be typically measured employing a laser diffraction type particle distribution meter, HELOS (manufactured by Sympatec Co.) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are, for example, olefin based resins, styrene based resins, styrene/acryl based resins, silicone based resins, ester based resins, fluorine containing polymer based resins, and the like. Resins to compose the resin-dispersed type carrier are, example, styrene acrylic resins, polyester resins, fluorine based resins, phenol resins, and the like.

Organic photoreceptors will now be described. It is preferable that the photoreceptor incorporates a cylindrical conductive support having thereon a photosensitive layer (including a single photosensitive layer and a photosensitive layer having a charge generating layer as well as a charge transport layer) via an interlayer incorporating inorganic particles, of a number average diameter of primary particles of 3-200 nm, in binder resins.

By employing the organic photoreceptors described as above, it is possible to minimize formation of fog and insufficient density at the leading edge portion which tend to occur due to use of the counter-development system, whereby it is possible to provide high quality digital images and color images.

The following describes the organic photoreceptor.

The organic photoreceptor refers to an electrophotographic photoreceptor equipped with at least one of an electric charge generating function essential to the configuration of the electrophotographic photoreceptor, and an electric charge transport function. It includes the photoreceptors composed of organic charge generating substances or organic charge transfer substances, and the organic photoreceptors such as the photoreceptor wherein the charge generating function and charge transfer function are provided by the high-molecular complex.

A flat toner is highly adhesive to carriers and developing sleeves, whereby developability tends to deteriorate. However, by employing the counter-development system, developability is improved and sufficient image density is achieved due to the synergistic effects with the area covering effect of the flat toner. On the contrary, flat toner particles on the developing sleeve tend to generate a reversely charged toner particles due to contact friction with the photoreceptor, resulting in tendency of the formation of fog and a decrease in density of the leading edge portion.

Incorporation of inorganic particles is arranged in the surface layer of a photoreceptor. Incorporation of the inorganic particles in the surface layer of a photoreceptor decreases contact friction of the photoreceptor with the flat toner which tends to occur in the counter-development system to minimize the formation of a reversely charged toner, whereby it is possible to minimize the formation of fog and a decrease in density of the leading edge portion, as well as toner scattering, and it is further possible to form electrophotographic images exhibiting high density and desired color reproduction.

The surface layer of the photoreceptor refers to the one which comes into contact with an air interface and may be a protective layer or a charge transport layer, the function of which is not specified.

Preferably as the surface layer of a photoreceptor is a charge transport layer or a protective layer which is provided on a charge transport layer.

Listed as inorganic materials incorporated in the surface layer are powder of metals such as copper, tin, aluminum, or indium; metal oxides such as silica, tin oxide, titanium oxide, alumina, indium oxide, antimony oxide, bismuth oxide, calcium oxide, tin oxide doped with antimony, or indium oxide doped with tin; metal fluorides such as tin fluoride, calcium fluoride, or aluminum fluoride; and inorganic materials such as potassium titanate or boron nitride.

It is preferable that the inorganic particles exhibit high resistance of at least $10^{10}$ Ωcm. By employing such inorganic particles, the decrease in resistance of the uppermost layer of a latent image holding body is retarded, whereby it is possible to effectively minimize the formation of low quality images.

Of the above inorganic particles, particularly usefully employed may be silica, titanium oxide, and alumina. Further, since these inorganic particles are easily available at lower cost compared to other metal oxide inorganic particles, it is possible to achieve reduction of production cost. These inorganic particles may be employed singly or in combination of at least two types.

Of these, in view of retardation of development blurring and enhancement of abrasion resistance, particularly useful is a type alumina of a hexagonal closest packed structure which exhibits high insulation, high thermal stability, and high abrasion resistance.

In view of enhancement of dispersibility and stabilization of electrophotographic characteristics, preferred are inorganic particles which are subjected to a surface treatment. For example, inorganic particles are added to a liquid composition which is prepared by dissolving or suspending reactive organic silicon compounds in organic solvent or water, and the resulting mixture is stirred from about several minutes to about one hour. In certain cases, after applying a heating treatment to the above mixture, drying is performed after processes such as filtration, whereby inorganic particles, the surface of which is covered with organic silicon compounds, is prepared. Reactive organic silicon compounds may be added to a suspension which is prepared by dispersing inorganic particles in organic solvents or water.

The amount of the reactive organic silicon compounds employed for the surface treatment is 0.1-50 parts by weight with respect to 100 parts by weight of titanium oxide treated with metal oxide in terms of quantity of preparation, and is more preferably 1-10 parts by weight. Thereby, it is possible to achieve preferred dispersibility of titanium oxide particles in the layer and preferred electric performance such as stabilized residual potential or electrostatic potential.

The reactive organic silicone compounds makes condensation reaction with a reactive group on the surface of the organic particles such as hydroxyl group, and whose examples represented by the following formula (1).

$$(R)_n—Si—(X)_{4-n} \quad (1)$$

In the above, Si is a silicon atom, R is an organic group directly bonded by the carbon atom thereof to the silicone atom, X is a hydrolyzable group and n is an integer of 0 to 3.

In the organic silicone compound represented by the above formula, the organic group represented by R which is directly bonded by the carbon atom thereof to the silicone atom is, for example, an alkyl group such as a methyl, ethyl, propyl, butyl, pentyl, hexyl, octyl or dodecyl group; an aryl group such as a phenyl, tolyl, naphthyl or biphenyl group; an epoxy group-containing group such as a γ-glycidoxypropyl or β-(3,4-epoxycyclohexyl)ethyl group; a (metha)acryloyl group-containing group such as a γ-acryloxypropyl or γ-methacryloxypropyl group; a hydroxyl group-containing group such as a γ-hydroxypropyl or 2,3-dihydroxypropyloxypropyl group, a vinyl group-containing group such as a vinyl or propenyl group; a mercapto group-containing group such as a γ-mercaptopropyl group: an amino group-containing such as a γ-aminopropyl or N-β(aminoethyl)-γ-aminopropyl group; a halogen-containing group such as a γ-chloropropyl, 1,1,1-trifluoropropyl, nonafluorohexyl or perfluoroctylethyl group; and a nitro group and a cyano-substituted alkyl group.

Examples of the hydrolyzable group include an alkoxy group such as a methoxy or ethoxy group; a halogen atom and an acyloxy group.

The organic silicone compound represented by the formula (1) may be employed singly or in combination of two or more kinds thereof.

In the compounds represented by the foregoing organic silicone compound, plural groups represented by $R_1$ may be the same or different when n is 2 or more. The plural groups represented by $X_1$ may be the same or different when n is 2 or more. The plural groups represented by $R_1$ and $X_1$ may be the same or different among these compounds when n is 2 or more.

A hydrogenpolysiloxane compound is preferably used as the reactive organic silicon compound to be used in the surface treatment. The hydrogenpolysiloxane having a molecular weight of from 1,000 to 20,000 is easily available and shows a suitable black spot inhibiting gration of black spots.

Another surface treatment of inorganic particles is one which is performed employing organic silicon compounds having fluorine atoms. It is preferable that the surface treatment, performed employing the above organic silicon compounds having a fluorine atoms, is performed under a wet process.

Organic silicon compounds having fluorine atoms are dissolved or suspended in organic solvents or water, and untreated inorganic particles are added to the above composition. The resulting mixture is mixed while stirring from about several minutes to about one hour. In some cases, after performing thermal treatment, drying is performed via processes such as filtration and the surface of inorganic particles is covered with organic silicon compounds having fluorine atoms. Organic silicon compounds having fluorine atoms may be added to a suspension prepared by dispersing inorganic particles in organic solvents or water.

Listed as organic silicon compounds having fluorine atoms are 3,3,4,4,5,5,6,6,6-nonafluorohexyltrichlorosilane, 3,3,3-trifluoromethoxysilane, methyl-3,3,3-trifluoropropyldichlorosilane, dimethoxymethyl-3,3,3-trifluoropropylsilane, and 3,3,4,4,5,5,6,6,6-nonafluorohexylmethyldichlorosilane.

Listed as other specific reactive organic titanium compounds which are employed for the surface treatment of inorganic particles are metal alkoxide compounds such as tetrapropoxytitanium or tetrabutoxytitanium, and metal chelate compounds such as diisopropoxytitanium bis(acetylacetate), diisoproxytitanium bis(ethylacetacetate), diisopropoxytitanium bis(lactate), dibutoxytitanium bis(octylene glycolate), or diisopropoxytitanium (triethanol aminate).

It is possible to disperse these inorganic particles together with charge transport materials, binding resins, and solvents employing an appropriate homogenizer. Further, the average diameter of the primary inorganic particles is preferably 3-150 nm, and is more preferably 5-100 nm, in view obtaining sufficient abrasion resistance and minimized scattering of writing light.

The primary particle diameter can be measured as follows. The primary particle diameter is number average primary particle diameter (D1) which can be measured by observing the sample cut from the cross section of the photoreceptor by microtome having diamond blade. To be more specific, a desired 100 particles are randomly selected from a photograph taken by a transmission electron microscope (acceleration voltage: 200 kV) and the Feret's diameter is measured to get the number average primary particle diameter (D1).

The content of inorganic particles in the surface layer varies depending on the type of employed inorganic particles or electrophotographic processing conditions using photoreceptors, but is preferably 5-60 percent by weight. Further, it is possible to incorporate these inorganic particles in the entire charge transport layer. However, since electric potential in exposed portions occasionally results in an undesirable increase, the following structures are preferred. The content of inorganic particles is subjected to gradient in such a manner that the uppermost surface side of a charge transport layer incorporates the largest amount of inorganic particles, while the conductive support side incorporates a lower amount. Alternatively, a charge transport layer is composed of a plurality of layers and the concentration of inorganic particles successively increases toward the surface side from the conductive support side. Further, when a protective layer is employed as a surface layer, incorporation of charge transport materials in the protective layer is very useful for maintaining the electric characteristics of photoreceptors such as retardation of degradation of photographic speed during repeated use and increase in residual potential. These are achieved in such a manner that by allowing the protective layer to exhibit desired charge transport properties, charges can smoothly migrate to the surface. Employed as such charge transport materials may be those employed in the charge transport layer to be described later.

The preferable constitution of photoreceptors is such that a charge generating layer and a charge transport layer are successively applied onto on a conductive support. Further, it is preferable that an interlayer is provided between the conductive support and the photosensitive layer. If desired, a constitution is available in which a surface protective layer is formed on the photosensitive layer.

Specific examples of preferred layer configurations of organic photoreceptors will now be described.

Conductive Support:

A sheet-like or cylindrical conductive support may be used as the conductive support for the photoreceptor. The cylindrical conductive support is preferable.

The cylindrical conductive support can be defined as a cylindrical support required to form images on an endless basis through rotation. The preferred cylindricity is 5 through 40 μm, and the more preferred one is 7 through 30 μm.

The cylindricity is based on the JIS (B0621-1984). To be more specific, when a cylindrical substrate is sandwiched between two coaxial geometrical cylinders, the cylindricity is expressed in terms of the difference of the radii at the position where a space between two coaxial cylinders is minimized. In the present invention, the difference in the radii is expressed in "μm". The cylindricity is gained by measuring the roundness at a total of seven points—two points 10 mm from both ends of the cylindrical substrate, a center, and four points obtained by dividing the space between both points and the center into three equal parts. A non-contact type universal roll diameter measuring instrument (by Mitsutoyo Co., Ltd.) can be used for this measurement.

The conductive support may include a metallic drum made of aluminum, nickel or the like, a plastic drum formed by vapor deposition of aluminum, tin oxide, indium oxide or the like, or a paper/plastic drum coated with conductive substance. The conductive support is preferred to have a specific resistance of $10^3$ Ωcm or less at the normal temperature.

A conductive support wherein the alumite film provided with porous sealing treatment on the surface is formed may be used. Alumite treatment is normally carried out in the acid bath containing a chromium oxide, sulfuric acid, oxalic acid, phosphoric acid, sulfamic acid or others. In sulfuric acid, the best result is obtained by anodization. In the case of anodization in sulfuric acid, preferred conditions include a sulfuric acid concentration of 100 through 200 g/l, aluminum ion concentration of 1 through 10 g/l, liquid temperature of around 20° C., and applied voltage of about 20 volts, without the preferred conditions being restricted thereto. The average thickness of the film formed by anodization is normally equal to or smaller than 20 μm, and is preferred to be equal to or smaller than 10 μm, in particular.

Further, in regard to organic photoconductors, in cases in which the outer diameter of the cylindrical support is 20-80 mm, curing is enhanced. In the case of the cylindrical support at an outer diameter of 20-80 mm, the linear surface speed of the photoreceptor in the image forming process tends to increase, whereby in the counter-development system, a decrease in density of the leading edge portion and fog formation tends to occur.

Interlayer

In the photoreceptor, an interlayer is provided between the conductive support and the photosensitive layer. The binder resins of the interlayer incorporate inorganic particles of an average diameter of the primary particle of 3-200 nm. By incorporating inorganic particles into the binder resins of the interlayer, blocking properties of free carriers (electrons and holes which are released from the conductive support) from the conductive support are enhanced. As a result, the formation of black spots and fogging is minimized, and developability is enhanced, whereby it is possible to minimize the decrease in density of the leading edge portion and to prepare electrophotographic images exhibiting desired image density.

Preferably employed as inorganic particles used in the interlayer are those composed of metal oxides such as titanium oxide ($TiO_2$), zinc oxide (ZnO), tin oxide ($SnO_2$), zirconium oxide, cerium oxide, iron oxide, aluminum oxide, tungsten oxide, or bismuth oxide. Further employed are metal carbides such as silicon carbide or titanium carbide; titanates such as strontium titanate, calcium titanate, or barium titanate; carbonates such as calcium carbonate; metal nitrides such as aluminum nitride; and sulfates such as barium sulfates, copper sulfate, or zinc sulfate.

Of these inorganic particles, preferred are N type semiconductive particles.

The N-type semiconductive particles are defined as the particles dispersed in the intermediate layer in cases where the light damping property, when negatively charged in the evaluation, is greater than that when positively charged.

The N-type semiconductive particles include the particles of titanium oxide ($TiO_2$), zinc oxide (ZnO) and tin oxide ($SnO_2$), and the titanium oxide is particularly preferable.

Employed as N type semiconductive particles are those of a number average diameter of the primary particles in the range of 3-200 nm, and the range of 5-100 is particularly preferred. As used herein, "number average diameter of the primary particles" refers to the value determined as follows. Minute particles are enlarged at a factor of 10,000 employing a transmission type electron microscope, and 100 randomly selected particles are observed as a primary particle. Subsequently, the number average diameter is determined as an average diameter in the FERE direction based on image analysis.

Crystal forms of titanium oxide particles include anatase, rutile, bruckite, and amorphous. Of these, rutile titanium oxide pigments and anatase titanium oxide pigments are most preferred as N-type semiconductive particles due to the following reasons. They enhance rectification properties of charges which pass through an interlayer, namely enhance electron mobility, to stabilize electrostatic potential, minimize an increase in residual potential, and simultaneously are capable of minimizing the generation of transfer memory.

A hydrogenpolysiloxane compound is preferably used as the reactive organic silicon compound to be used in the last surface treatment of the N-type semiconductive particles. The hydrogenpolysiloxane having a molecular weight of from 1,000 to 20,000 is easily available and shows a suitable black spot inhibiting ability, and gives good half tone image The polymer containing a methylhydrogensilixane unit is preferably a copolymer of a structural unit of —($HSi(CH_3)O$)— and another siloxane unit. Preferable another siloxane unit is a dimethylsioxane unit, a methylethylsiloxane unit, a methylphenylsiloxane unit and a diethylsiloxane unit, and the dimethylsiloxane unit is particularly preferred. The ratio of the methylhydrogensiloxane unit in the copolymer is from 10 to 99 mole percent, and preferably from 20 to 90 mole percent.

The methylhydrogensiloxane copolymer is preferably a random copolymer or a block copolymer, even though a random copolymer, a lock copolymer and a graft copolymer are usable. The copolymerizing composition other than the methylhydrogensiloxane may be one or more kinds.

It is further possible to employ N-type semiconductive particles which are subjected to a surface treatment employing the reactive organic silicon compounds represented by the following formula:

$$(R)_n—Si—(X)_{4-n}$$

wherein Si represents a silicon atom, R represents an organic group in which carbon directly bonds to the above silicon atom, X represent a group which is subjected to hydrolysis, and n represents an integer of 0-3.

In the organic silicon compounds represented by the above general formula, the organic group represented by R, in the form, in which carbon directly bonds to silicon, include alkyl groups such as methyl, ethyl, propyl, butyl, pentyl, hexyl, octyl, or dodecyl; aryl groups such as phenyl, tolyl, naphthyl, or biphenyl; epoxy containing groups such as β-(3,4-epoxycyclohexyl)ethyl; (meth)acryloyl containing groups such as γ-acryloxypropyl or γ-methaacryloxypropyl; hydroxyl containing groups such as γ-hydroxypropyl or γ-2,3-dihydroxypropyloxypropyl; vinyl-containing groups such as vinyl or propenyl; mercapto containing groups such as γ-mercaptopropyl group; amino containing groups such as γ-aminopropyl or N-β(aminoethyl)-γ-aminopropyl; halogen containing groups such as γ-chloropropyl, 1,1,1-trifluoropropyl, nonafluorohexyl, or perfluorooctylethyl; and other groups such as nitro- or cyano-substituted alkyl groups. Further, the groups represented by X, which are subjected to hydrolysis include alkoxy groups such as methoxy or ethoxy, halogen groups, and acyloxy groups.

Further, silicon compounds represented by the above formula may be employed individually or in combination of at least two types.

Further, in specific examples of the organic silicon compounds represented by the above formula, when n represents 2 or more, a plurality of Rs may be the same or different. Further, employed are at least two types of the organic silicon compounds represented by the above formula, R and X may be the same or different among each of the compounds.

Still further, prior to the surface treatment of methyl hydrogen siloxane copolymers and reactive organic silicon compounds, N type semiconductive particles may be subjected to a surface treatment employing silica and alumina.

The aforesaid alumina and silica treatments may simultaneously be performed, but it is specifically preferable that the alumina treatment is initially performed, followed by the silica treatment. Further, when each of the alumina and silica treatments is performed, it is preferable that the treatment amount of silica is more than that of alumina.

Surface treatments of minute N-type semiconductive particles by metal oxides such as alumina, silica, or zirconia may be performed employing a wet process.

Binder resins in the interlayer are preferably alcohol-soluble polyamide resins. It is known that in order to form the interlayer of uniform thickness, resins which exhibit desired solubility in solvents are necessary. Therefore, the above alcohol-soluble polyamide resins are preferred.

The number average molecular weight of the polyamide resins is preferably 5,000-80,000, but is more preferably 10,000-60,000. When the number average molecular weight is at most 5,000, the thickness uniformity of the interlayer is degraded, whereby desired effects tend to be hardly exhibited, while when it is at least 80,000, solubility of the resins in solvents tends to decrease, whereby aggregated resins tend to form in the interlayer, and fogging and decrease in density of the leading edge portion in halftone images tend to result.

As solvents which dissolve polyamide resins and prepare liquid coating compositions are preferably alcohols, having 2-4 carbon atoms, such as ethanol, n-propyl alcohol, isopropyl alcohol, n-butanol, t-butanol, or sec-butanol, which results in desired solubility of polyamides and desired coatability of the resulting liquid coating compositions. The content of these solvents is commonly 30-100 percent by weight with respect to the total solvents, is preferably 40-100 percent by weight, but is more preferably 50-100 percent by weight. Listed as assisting solvents which are employed together with solvents to result in preferred effects are methanol, benzyl alcohol, toluene, methylene chloride, cyclohexanone, and tetrahydrofuran. The thickness of the interlayer is preferably 3-10 μm. When the thickness of the interlayer is less than 0.5 μm, formation of black spots and a decrease in density of the leading edge portion of halftone images tend to occur, while when it exceeds 10 μm, an increase in residual potential and transfer memory tends to occur, whereby sharpness tends to degrade. The thickness of the interlayer is more preferably 0.5-5 μm.

Selected as solvents to prepare liquid coating compositions may be organic solvents known in the art, such as alcohol based, aromatic compound based, halogenated hydrocarbon based, ketone based, ketone alcohol based, ether based, or ester based solvents.

It is also possible to employ common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetraydrofuran, methylene chloride, chloroform, chlorobenzene, or toluene.

Further, these solvents employed to prepare dispersions may be employed individually or in combination of at least two types. Any solvents may be employed as long as their mixtures are capable of dissolving binder resins.

Employed as methods in which inorganic particles, which have been subjected to a surface treatment employing reactive organic silicon compounds, are dispersed into binder resins are those employing a roll mill, a ball mill, a vibration ball mill, an attritor, a sand mill, a colloid mill, or a paint shaker. Employed as coating methods to further provide the aforesaid sublayer may be common coating ones such as a blade coating method, a wire bar coating method, a spray coating method, a dip coating method, a bead coating method, an air knife coating method, or a curtain coating method.

Photosensitive Layer

A charge generating layer (CGL) is a layer incorporating charge generating materials (CGMs) as a main component, and if desired, binder resins may be employed.

It is possible to employ, as a charge generating material, materials known in the art. Examples include phthalocyanine based pigments such as metal phthalocyanine or metal-free phthalocyanine, azulenium salt pigments, squaric acid methane pigments, azo pigments having a carbazole skeleton, azo pigments having a triphenylamine skeleton, azo pigments having a diphenylamine skeleton, azo pigments having an oxadiazole skeleton, azo pigments having a bisstilbene skeleton, azo pigments having a distyryloxadiazole skeleton, azo pigments having a distyrylcarbazole skeleton, perylene based pigments, anthaquinone based or polycyclic quinone based pigments, quinoneimine based pigments, diphenylmethane and triphenylmethane based pigments, benzoquinone and naphthoquinone based pigments, cyanine and azomethine based pigments, indigoid based pigments, and bisbenzimidazole based pigments. These charge generating materials may be employed individually or in combination of at least two types.

Of CGMs, when phthalocyanine based pigments are employed, effects are markedly exhibited. Potential characteristics of organic photoreceptors in which titanyl phthalocyanine pigments or gallium phthalocyanine pigments are employed as a charge generating material tend to result in variation. However, the use of an interlayer minimizes the variation, and even though an image forming method employing the counter-development system is employed, it is possible to minimize the formation of fog and the generation of a decrease in density of leading edge portion.

In case of using a binder as a dispersing medium of a CGM in the charge generating layer, a resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight part. Increase in residual electric potential with repeated use can be minimized by using these resins. The layer thickness of the charge generating layer is preferably in the range of 0.3 to 2 μm.

Charge Transport Layer (CTL)

A charge transport layer is one achieving the purpose in which static charges are maintained, and are combined with static charges which are generated in a charge generating layer via exposure, separated and conveyed. In order to achieve the purpose of maintaining static charges, high electric resistance is required. Further, in order to achieve the purpose of resulting high surface potential utilizing the retained static charges, a low dielectric constant and high electric charge mobility are required. In order to satisfy these requirements, the charge transport layer is composed of charge transport materials (CTMs) and if desired, binder resins. It is possible to prepare the above charge transport layer in such a manner that charge transport materials and binders are dissolved or dispersed in suitable solvents and the resulting liquid composition is coated and dried. If desired, it is possible to incorporate, in the above charge transport layer, additives such as plasticizers, antioxidants, and leveling agents in an appropriate amount, other than charge transport materials and binders. Charge transport materials include positive hole transport materials and electron transport materials. However, in layer fabrication of organic photoreceptors, the positive hole transport materials are more preferred.

The charge transport layer incorporates charge transport materials (CTMs) and binders which are employed to disperse CTMs and to form a layer. If desired, additives such as antioxidants may be incorporated as other materials.

As a charge transporting material (CTM), a known charge transporting material (CTM) of the positive hole transportation type (P type) can be used. For example, triphenylamines, hydrazones, styryl compound, benzidine compound, butadiene compound can be applied. These charge transporting materials are usually dissolved in a proper binder resin to form a layer.

As the binder resin for charge transporting layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly —N— vinyl carbazole may be usable. The most preferred material is polycarbonate resin in view of, smaller water absorbing rate, dispersing ability of the CTM and electro photosensitive characteristics.

Ratio of the binder resin is preferably 50 to 200 parts by weight to 100 parts of charge transporting material by weight. Total thickness of the CTL is preferably 20 μm or less, and more preferably 10 to μ6 mm.

Moreover, it is preferable to make the surface layer containing the fluorine-containing resin fine particles contain an antioxidant. Although the surface layer containing a fluorine-containing resin fine particles tends to oxidize with activated gas at the time of charging of a photoreceptor, for example, NOx, ozone, etc., and easily generates a blur image, the occurrence of a blur image can be prevented by making an antioxidant exist together with it. The antioxidant is a material, as a typical one, having a character to prevent or control an action of oxygen under conditions, such as light, heat, and electric discharge, to an auto-oxidizing substance which exists in an organic photoreceptor or on the surface of an organic photoreceptor. Typically, the following compound groups are listed.

1-1

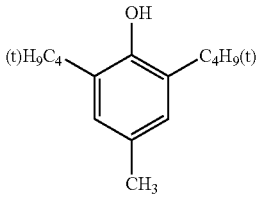

1-2

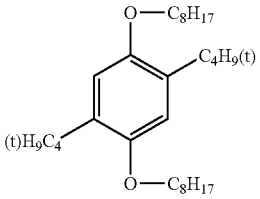

1-3

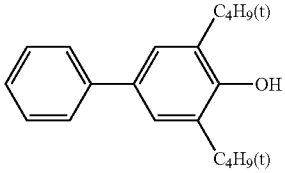

1-4

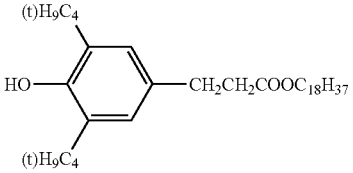

1-5

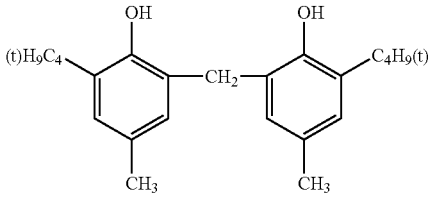

1-6

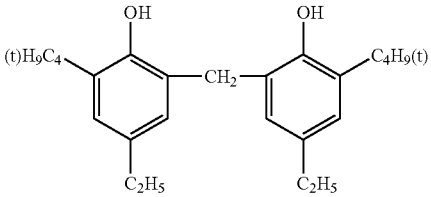

1-7

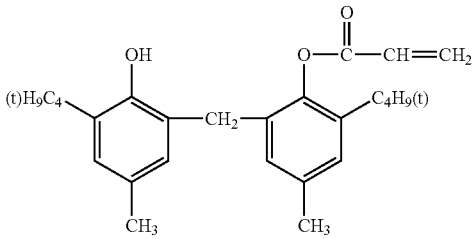

1-8

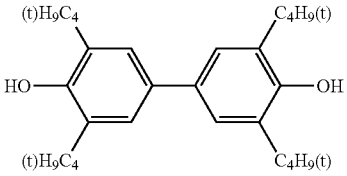

1-9

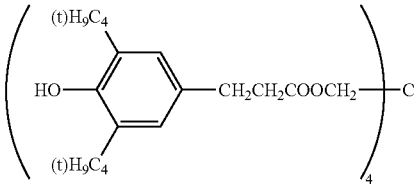

-continued
1-10
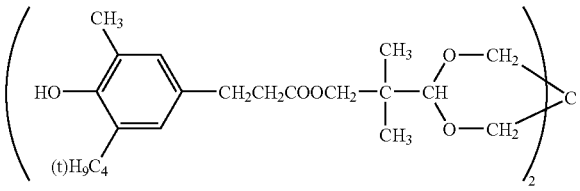
1-11
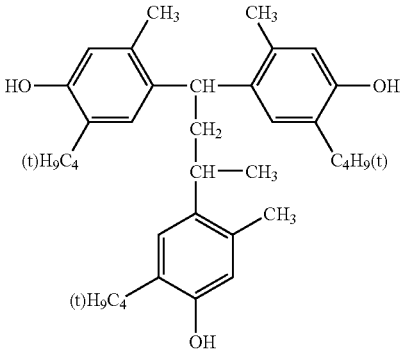
2-1
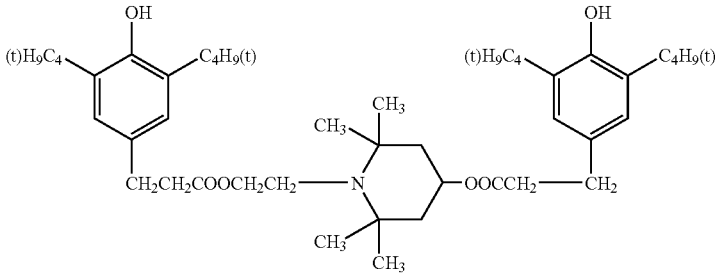
2-2
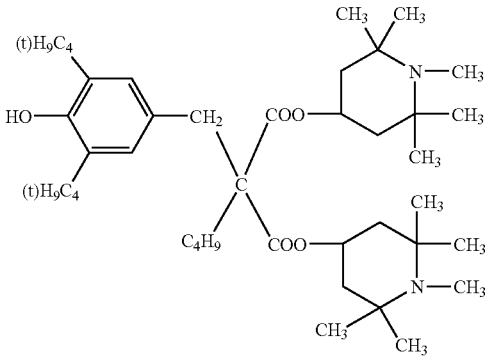
2-3
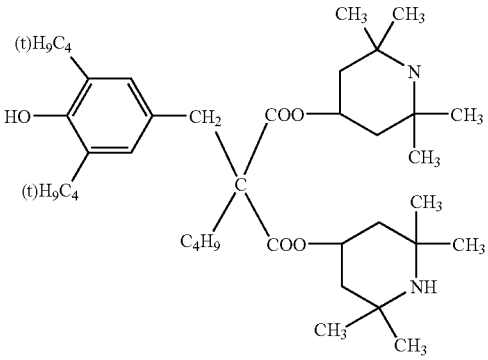
2-4
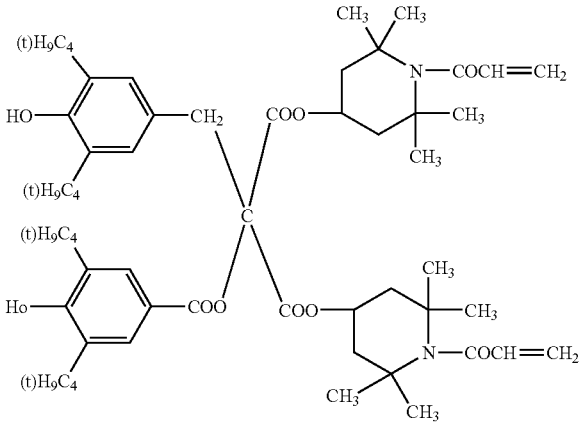

-continued 2-5

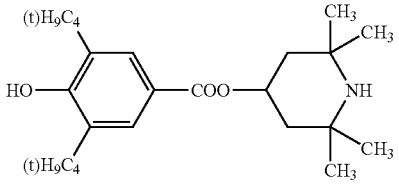

2-6

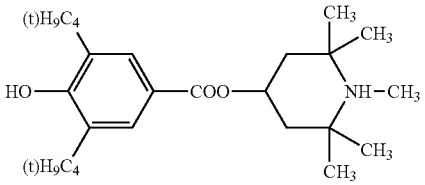

2-7

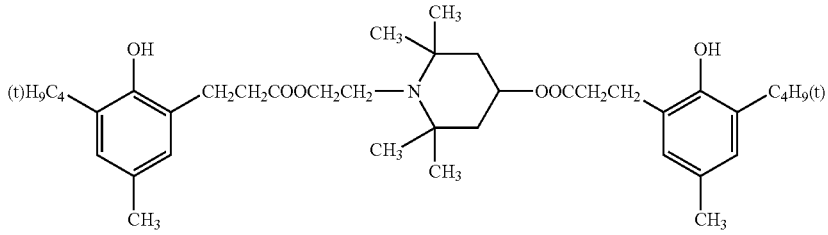

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

The developing device of the counter-direction development system will now be described with reference to FIG. 3. Developing device 102 is constituted as follows. In the aperture section of developer container 110 containing a two-component developer, cylindrical developing sleeve 120, in which cylindrical magnet 121 is arranged to non-rotating, faces organic photoreceptor 101. Above developing sleeve 120 rotates in the opposite direction with respect to organic photoreceptor 101, which rotates in the arrowed direction and conveys a developer which is adsorbed and remains on the surface to a development section on the organic photoreceptor 101. Magnet 121 has development magnetic pole N1 on photoreceptor 101 side, and in the rotation direction of developing sleeve 120 from above development magnetic pole N1, has first conveying magnetic pole S3, second conveying magnetic pole N2, third conveying magnetic pole S2, and toner collecting magnetic pole S1 composing the third conveying magnetic pole and a spaced magnetic pole.

The developer in development vessel 110 is adsorbed and maintained on developing sleeve 120 at position Q (being the toner collecting position) on developing sleeve 120 corresponding to toner collecting pole S1 of magnet 121 via action of toner collecting pole S1. After the thickness of the developer layer is regulated by developing blade 122, the developer is conveyed to a development section. In the development section, a magnet brush is formed by the action of development magnetic pole N1 and the resulting magnet brush is brought into contact with a photoreceptor, namely the developing sleeve is brought into contact with the photoreceptor, whereby the latent image on photoreceptor 101 is developed.

A preferred embodiment of a counter developing mode is explained. Incidentally, here, a gap between the photoreceptor 101 and the developing sleeve 120 in the developing section neighboring the developing magnet N1 in FIG. 3 is called a developing gap (Dsd), and the height of the magnetic brush formed on the developing sleeve 120 by the developing magnet N1 is called a developing brush height (h).

(1) Developing Gap (Dsd): 0.2 to 0.6 mm

When Dsd is made 0.2 to 0.6 mm, the development is conducted under a strong developing electric field and the attraction force to attract magnetic carriers onto the developing sleeve become larger so that the magnetic carriers are prevented from shifting and adhering onto the photoreceptor. Further, the developing electric field in the developing gap becomes higher, an edge effect becomes reduced and a developing ability is enhanced. Therefore, thinning of a transverse line image and a whitening of a trailing edge portion (developing failure at a trailing edge portion) can be prevented and the developing ability for a solid image can be enhanced.

(2) Magnetic Brush Bent Depth (Bsd): 0 to 0.8 mm, here, the Magnetic Brush Bent Depth (Bsd)=the Developing Brush Height (h)−the Developing Gap (Dsd)

Figure 3:
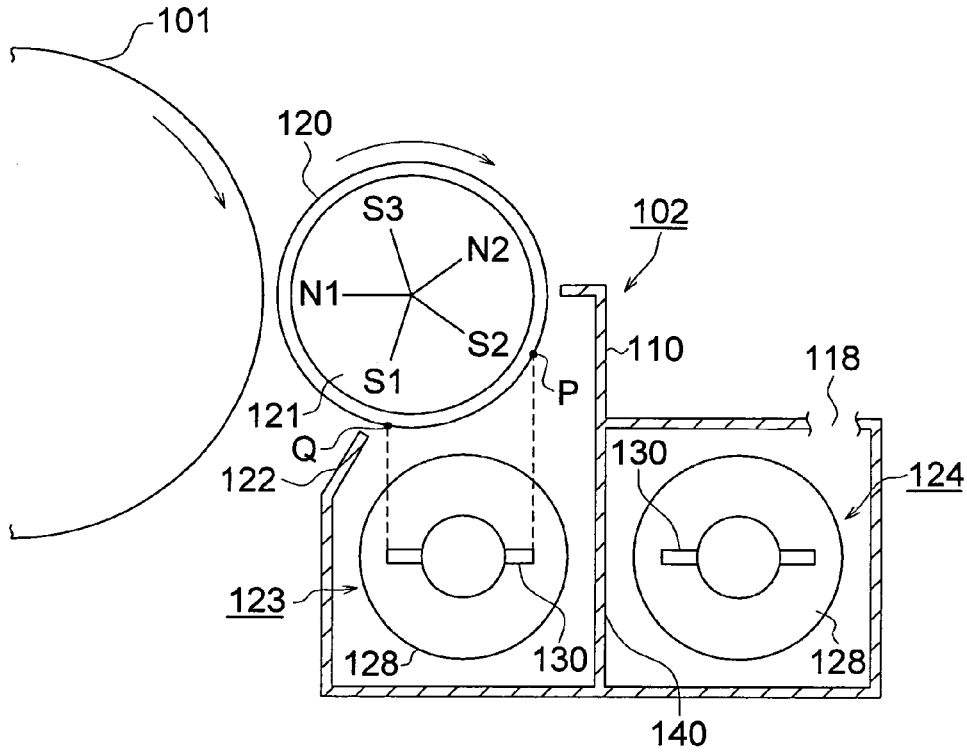
FIG. 3 is a sectional view of a developing device employing an opposite direction development method.

When the magnetic brush bent depth (Bsd) is made 0 to 0.8 mm, the compression for the developing agent at the developing section is reduced and developing agent is prevented from slipping through a gap between the developing sleeve 120 and the developing blade which is not shown in FIG. 3. A developing failure for an isolating dot caused by an uneven contact of a magnetic brush and an increase of a roughness on a halftone image can be prevented. When the magnetic brush bent depth (Bsd) is less than zero, that is, under non contact condition, lowering of a developing density tends to take place. On the other hand, when the magnetic brush bent depth (Bsd) is larger than 0.8 mm, the developing agent flows out from a nip section and a even image formation is not expected.

(3) Peripheral Speed Ratio of Developing Sleeve to Photoreceptor (Vs/Vopc): 1.2 to 3.0

When the peripheral speed ratio of developing sleeve to photoreceptor (Vs/Vopc) is made 1.2 to 3.0, a high developing ability can be obtained. If the peripheral speed ratio is increased excessively, the contact frequency of magnetic brush on the developing sleeve against the photoreceptor becomes high excessively. Then, the contacting force of the magnetic brush against the photoreceptor, that is, a mechanical force becomes strong excessively and carrier tends to separate away from the magnetic brush and the carrier tends to adhere onto the photoreceptor. As a result, a brush mark is caused on a toner image on the photoreceptor by the magnetic brush. On the contrary, if the peripheral speed ratio is decreased excessively, the contact frequency of magnetic brush on the developing sleeve against the photoreceptor reduces excessively, the developing ability is lowered. Therefore, when the peripheral speed ratio is less than 1.2, the image density becomes low, and when the peripheral speed ratio is larger than 3.0, toner scattering, carrier adhesion, a durability problem of the developing sleeve may take place. In contrast, when the peripheral speed ratio is made within the above range, the brush mark can be prevented. Further, the edge effect is prevented from being enhanced due to an excessive high developing ability.

(4) Developing Bias Condition

It is desirable that a difference |Vo−Vdc| between the surface electric potential Vo of the photoreceptor and a direct-current component Vdc of a developing bias is made 100 to 300 V, a direct-current component Vdc of a developing bias is made −300 V to −650 V, an alternate current component Vac of the developing bias is made 0.5 to 1.5 KV, frequency is made 3 to 9 KHz, duty ratio is made 45 to 70% (the time ratio of the developing side in a rectangular wave), the shape of the alternate current component is made to be a rectangular wave. Namely, in a small size two component type developing apparatus in which the outer diameter of the developing sleeve is 30 mm or less and the outer diameter of the photoreceptor is 60 mm or less, since a developing nip width becomes small due to the small diameter of the developing sleeve, the developing ability becomes lowered. However, with the above developing bias condition, the lowering of the developing ability can be improved.

The preferred embodiments of the counter developing system is explained basically using two component type developer. However, it may be also applied to magnetic or non-magnetic single component developer. The developer, in which the toner concentration has decreased due to development, is maintained on developing sleeve 120 by the action of first and second conveying magnetic poles S3 and N2, is returned to development vessel 110, and peeled from developing sleeve 120 and dropped at position P (being the developer dropping position) on the surface of developing sleeve 120 in which magnetic flux density between third conveying magnetic pole S2 and toner collecting magnetic pole S1 is minimal. Developing sleeve 120 from which the developer has been peeled is subjected to adsorption and retention of a fresh developer at toner collecting position Q in the same manner as above.

Under developing sleeve 120 in development vessel 110, first stirring conveying member 123 is arranged and via partition 140, second stirring conveying member 124 is further arranged. These first and second stirring conveying members 123 and 124 are screw-types and have a spiral screw blade 128 and plate-shaped projection 130 at the joint.

The developer, at a lower concentration of the toner, which has been peeled from the surface of developing sleeve 120, falls on first stirring conveying member 123, while stirring, conveyed with the adjacent developer in the axis direction employing first stirring conveying member 123 and is received by second stirring conveying member 124 through an aperture (not shown) of one end of partition 140. Second stirring conveying member 124 blends the received developer with the toner fed from feeding aperture 118 of development vessel 110 and conveys the resulting mixture via reverse rotation, which passes through the aperture (not shown) of the other end of partition 140 and returns to the side of first stirring conveying member 123.

Figure 4:
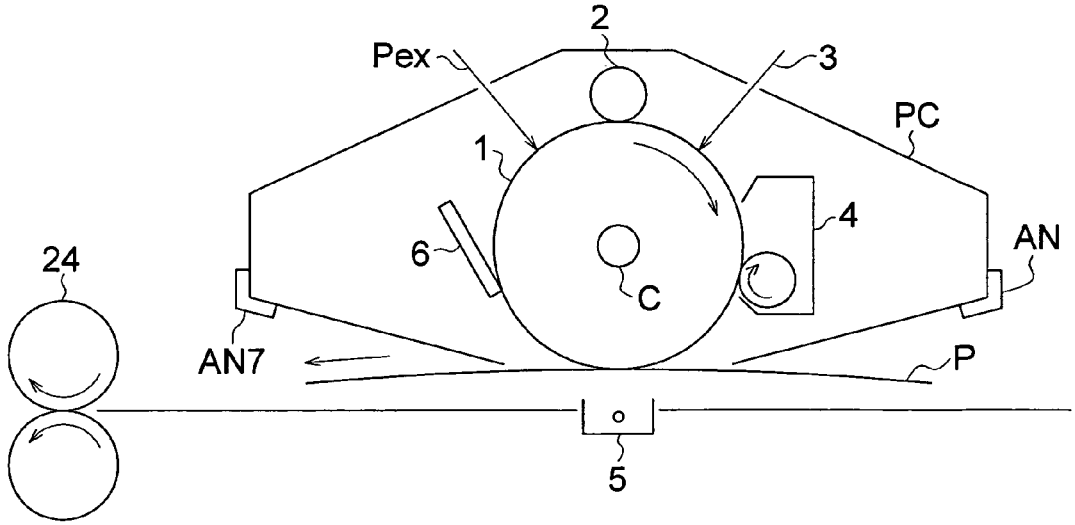
FIG. 4 is a schematic view of the structure of an electrophotographic apparatus incorporating a processing cartridge including a photoreceptor.

The processing cartridge and the electrophotographic apparatus of the present invention will now be described. FIG. 4 is a schematic view of the structure of an electrophotographic apparatus incorporating a processing cartridge incorporating an organic photoreceptor.

In FIG. 4, numeral 1 is a drum-shaped organic photoreceptor (being a photoreceptor) which rotates in the arrowed direction at a specified peripheral rate, while utilizing shaft C as a center. During rotation process, organic photoreceptor 1 is subjected to uniform charging at a specified positive or negative potential on its peripheral surface, employing charging means 2, and subsequently receives exposure light 3 which has be intensified and modulated in response to chronological electric digital image signals of the targeted image information outputted from an exposure means (not shown) such as slit exposure or laser beam scanning exposure. In such a manner, electrostatic latent images corresponding to the targeted image information are successively formed on the peripheral surface of organic photoreceptor 1.

Subsequently, the electrostatic latent image, formed as above, is subjected to toner development employing development means 4, and toner images which have been formed and retained on the surface of photoreceptor 1 are successively transferred, employing transfer means 5, onto transfer material P which has been fed between organic photoreceptor 1 and transfer means 5 from a paper feeding section (not shown) while synchronized with the rotation of photoreceptor 1.

Transfer material P, which has been subjected to toner image transfer, is separated from the surface of the photoreceptor and conveyed to image fixing means 24 to have the image fixed, and resulting image products (being prints or copies) are discharged from the apparatus.

The surface of organic photoreceptor 1 which has completed transfer is cleaned by removing any residual toner, employing cleaning means 6, is further subjected to a charge elimination treatment by pre-exposure light Pex from a pre-exposure means (not shown), and is used for repeated image formation. In cases in which charging means 2 is a contact charging means employing a charging roller, pre-exposure is not always necessary.

A plurality of constituting elements including above organic photoreceptor 1, charging means 2, development means 4, and cleaning means 6 may be integrated and housed in case PC as a removable processing cartridge which may be loaded in the electrophotographic apparatus, as for copiers or laser beam printers. Further, at least one of charging means 2, development means 4 and cleaning means 6 is integrated with organic photoreceptor 1 to form a cartridge. It is possible to use the resulting removable cartridge as a processing cartridge which is loaded in the apparatus itself employing guiding means AN7 and AN, being such as rails.

Described as a full color image forming apparatus will be an embodiment of an electrophotographic system printer (hereinafter referred simply to as a printer).

Figure 5:
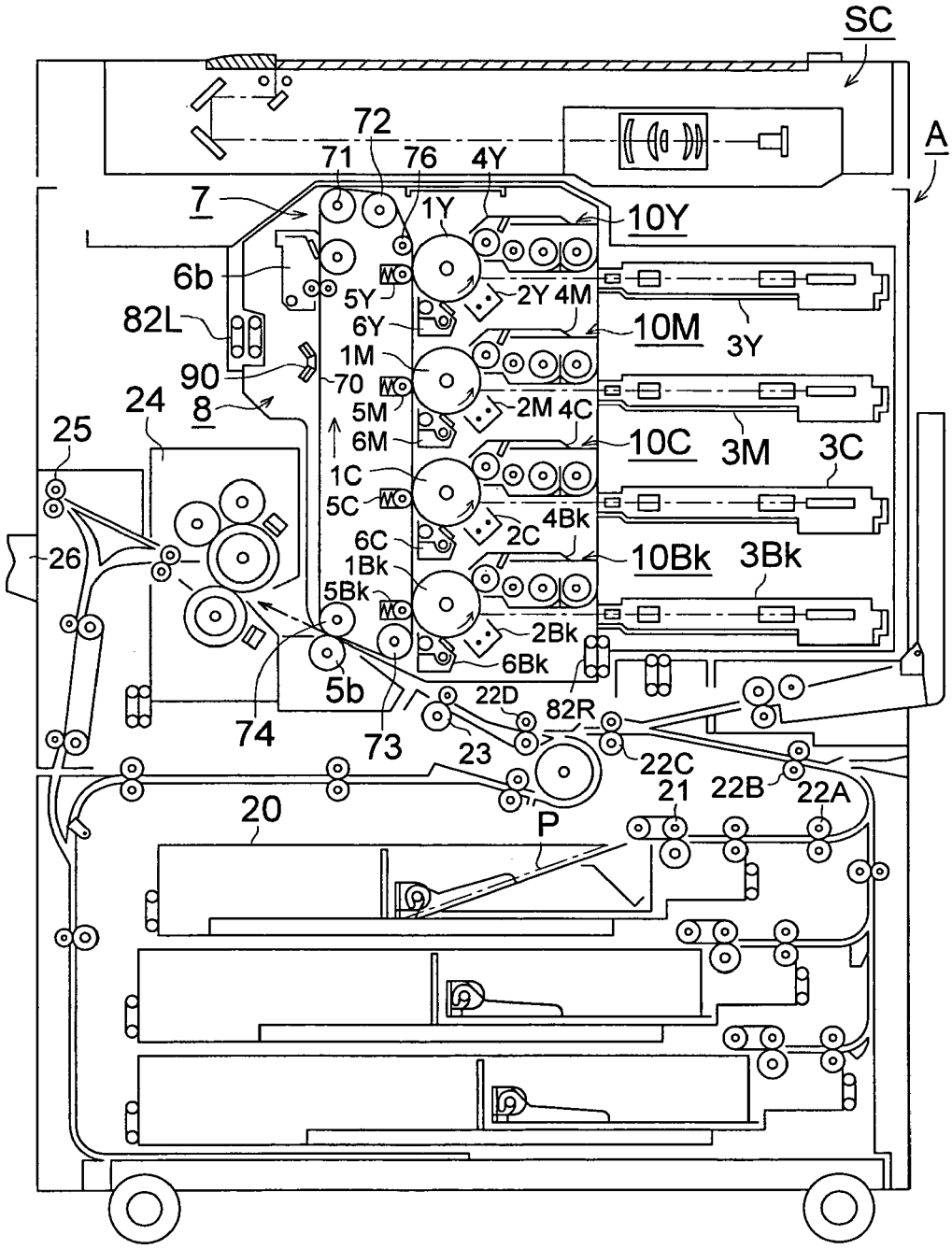
FIG. 5 is a sectional view of the structure of a color image forming apparatus showing an embodiment of the present invention.

FIG. 5 is a sectional view of a color image forming apparatus which shows one embodiment.

The above color image forming apparatus is called a tandem type color forming apparatus, which is composed of image forming section (being an image forming unit) of four groups of 10Y, 10M, 10C, and 10Bk, looped intermediate transfer unit 7, paper conveying means 21, and fixing means 24. Original document image reading apparatus SC is arranged above main body 7 of the image forming apparatus.

Image forming section 10Y, to form yellow images, is composed of charging means 2Y, exposure means 3Y, development means 4Y, primary transfer roller 5Y as a primary transfer means, and cleaning means 6Y, which are arranged around the periphery of drum-shaped photoreceptor 1Y as a first image carrier. Image forming section 10M which forms magenta images is composed of drum-shaped photoreceptor 1M as a first image carrier, charging means 2M, exposure means 3M, development means 4M, primary rotation roller 5M as a primary transfer means, and cleaning means 6M. Image forming section 10C which forms cyan images is composed of image forming section 11C which forms cyan images, drum-shaped photoreceptor 1C as a first image carrier, charging means 2C, exposure means 3C, development means 4C, primary rotation roller 5C as a primary transfer means, and cleaning means 6C. Image forming section 10Bk which forms black images is composed of drum-shaped photoreceptor 1Bk as a first image carrier, charging means 2Bk, exposure means 3Bk, development means 4Bk, primary transfer roller 5Bk as a primary transfer means, and cleaning means 6Bk.

Image forming units of the four groups of 10Y, 10M, 10C, and 10K are composed of rotating charging means 2Y, 2M, 2C, and 2K, image exposure means 3Y, 3M, 3C, 3K, rotating development means 4Y, 4M, 4C, and 4K, and cleaning means 5Y, 5M, 5C, and 5K which clean photoreceptor drums 1Y, 1M, 1C, and 1K, all of the above arranged around respective photoreceptor drums 1Y, 1M, 1C and 1K.

Image forming units 10Y, 10M, 10C, and 10K are constituted in the same manner except that the color of the toner images which are formed on photoreceptors 1Y, 1M, 1C and 1Bk differ, whereby image forming unit 10Y is exemplified and detailed.

In image forming unit 10Y, charging means 2Y (hereinafter referred to as charging means 2Y or charging unit 2Y), exposure means 3Y, development means 4Y, and cleaning means 5Y (hereinafter referred to as cleaning means 5Y or cleaning blade 5Y) on the periphery of photoreceptor drum 1Y which is an image forming body, and yellow (Y) toner images are formed on photoreceptor drum 1Y. Further, in the present embodiment, this image forming unit 10Y is arranged so that photoreceptor 1Y integrates at least any one of charging means 2Y, development means 4Y, and cleaning means 5Y.

Charging means 2Y is a means to provide uniform potential on photoreceptor drum 1Y. In the present embodiment, corona discharging type charging unit 2Y is used for photoreceptor drum 1Y.

Image exposure means 3Y is a means to form an electrostatic latent image corresponding to the yellow image while performing exposure onto photoreceptor drum 1Y which has been charged based on image signals (yellow). Employed as above exposure means 3Y is one composed of LEDs in which light emitting elements are arranged in the form of an array in the axial direction of photoreceptor drum 1Y and image forming elements (CELFOC LENS, a trade name), or a laser optical system.

In this image forming method, when electrostatic latent images are formed on a photoreceptor, it is preferable that image exposure is performed employing an exposure beam of a spot area of at most 2,000 $\mu m^2$. Even though beam exposure of such a small spot diameter is performed, the organic photoreceptor is capable of forming images which faithfully correspond to the above spot area. The spot area is more preferably 100-1,000 $\mu m^2$. As a result, it is possible to achieve formation of electrophotographic images of at least 800 dpi (dpi being the number of dots per 2.54 cm) exhibiting sufficient gradation.

As used herein, the "spot area of exposure beam" refers to the area corresponding to a region in which a light intensity is at least $1/e^2$ of the maximum peak intensity in the light intensity distribution plane which appears on a cut plane when the above exposure beam is cut employing a plane perpendicular to the beam.

Employed beams include a scanning optical system employing semiconductor lasers, as well as solid scanners such as LED or a liquid crystal shutter, while the light intensity distribution includes a Gauss distribution or Lorenz distribution. In either case, the portion reaching $1/e^2$ of each of the peak intensity is designated as the spot area.

Looped intermediate transfer body unit 7 is composed of looped intermediate transfer body 70 (being a transfer medium) as a semiconductive looped second image carrier which is entrained on a plurality of rollers and circulates repeatedly.

Each color image formed employing image forming units 10Y, 10M, 10C, and 10Bk is successively transferred onto looped intermediate transfer body 70 which is entrained on primary transfer rollers 5Y, 5M, 5C, and 5Bk as a primary transfer means, whereby a synthesized color image is formed. Transfer material (transfer medium) P as a transfer material (being a support to carry the final fixed image, for example, plain paper or a transparent sheet) loaded in paper feeding cassette 20 is fed employing paper feeding means 21, passes through a plurality of intermediate rollers 22A, 22B, 22C, and 22D, and registration roller 23, is conveyed by secondary transfer roller 5*b*, serving as a secondary transfer means, whereby secondary transfer is performed onto transfer material P and several color images are collectively transferred. Transfer material P, onto which color images have been transferred, is subjected to a fixing treatment employing fixing means 24, and is nipped by paper discharging rollers 25 and deposited into paper discharging tray 26 outside the apparatus. Transfer medium, as described herein, refers to a transfer medium of toner images on the photoreceptor such as an intermediate transfer body or a transfer material.

On the other hand, after transferring color images onto transfer material P employing secondary transfer roller 5*b* as a secondary transfer means, the residual toner on looped intermediate transfer body 70, which has been separated from transfer material P employing curvature, is removed employing cleaning means 6*b*.

During the image forming process, primary transfer roller 5Bk is always brought into pressure contact with photoreceptor 1Bk. Other primary transfer rollers 5Y, 5M, and 5C are brought into pressure contact with each of corresponding photoreceptors 1Y, 1M, or 1C only when a color image is being formed.

Secondary roller 5*b* is brought into pressure contact with looped intermediate transfer body 70 only when transfer material P passes a specified position and effects secondary transfer.

Further, enclosure 8 is structured so that it is possible to remove it from apparatus main body A via supporting rails 82L and 82R.

Further, enclosure 8 is composed of image forming sections 10Y, 10M, 10C, and 10 Bk, as well as looped intermediate transfer body unit 7.

Image forming sections 10Y, 10M, 10C, and 10Bk are arranged lengthwise in the perpendicular direction. Endless looped intermediate transfer body unit 7 is arranged on the left side of photoreceptors 1Y, 1M, 1C, and 1Bk. Looped intermediate transfer body unit 7 is composed of looped intermediate transfer body 70 entrained on rollers 71, 72, 73, and 74, primary transfer rollers 5Y, 5M, 5C, and 5Bk, as well as cleaning means 6*b*.

Figure 6:
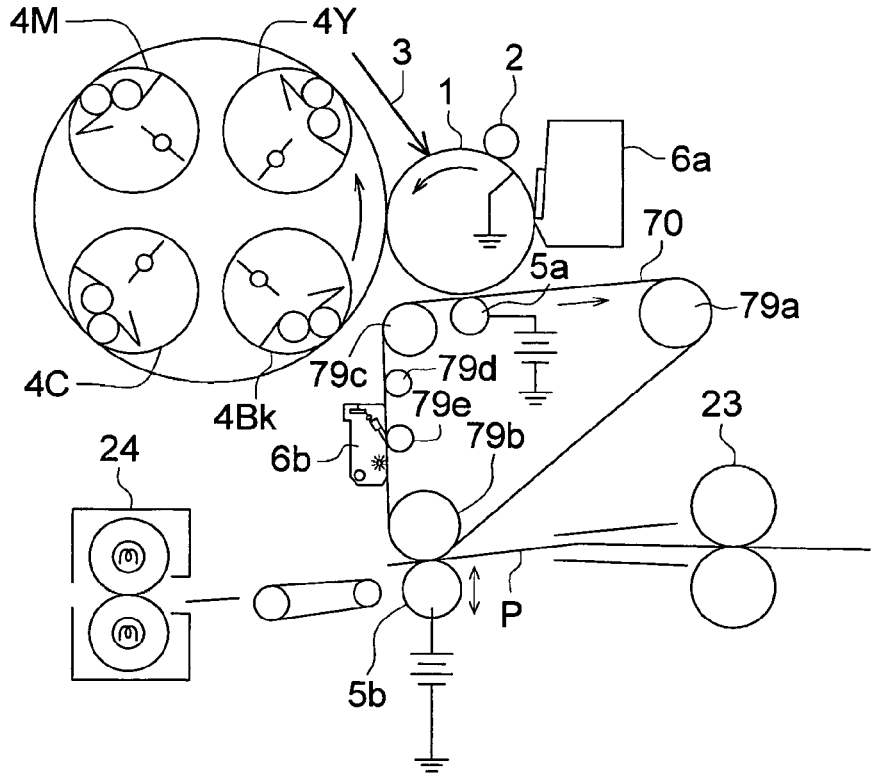
FIG. 6 is a sectional view of the structure of the color image forming apparatus showing an embodiment of the present invention.

FIG. 6 is a sectional view of the structure of a color image forming apparatus (such as a copier or a laser beam printer having at least a charging means, an exposure means, a plurality of developing means, a transfer means, a cleaning means, and an intermediate transfer body around an organic photoreceptor). Employed as looped intermediate transfer body 70 is an elastic martial at a medium resistance.

Numeral 1 is a rotating drum type photoreceptor which is repeatedly employed as an image forming body and rotates at a specified peripheral rate in the counter-clockwise direction, as shown by an arrow.

During rotation, photoreceptor 1 is subjected to uniform charging at a specified polarity and potential, and subsequently, is subjected to image exposure by scanning exposure light employing laser beams modulated in response to chronological electric digital pixel signals of image information, whereby an electrostatic latent image corresponding a color component image of yellow (Y) of the targeted color image is formed.

Subsequently, the resulting latent image is developed by yellow toner which forms the first color image, employing development means (being the yellow development unit) 4Y of yellow (Y). During the above operation, each of second-fourth development means (being the magenta development unit, the cyan development unit, and the black development unit) 4M, 4C, and 4Bk is not operated and does not act on photoreceptor 1, whereby the yellow toner image as a first color image is not affected by the second-fourth development units.

Intermediate transfer body is entrained on rollers 79*a*, 79*b*, 79*d*, and 79*e* and rotates in the clockwise direction and at the same peripheral rate as photoreceptor 1.

During the process in which the yellow toner image as the first color, which has been formed and maintained on photoreceptor 1, passes the nip section of photoreceptor 1 and intermediate transfer body 70, intermediate transfer (being a primary transfer) onto the outer peripheral surface of intermediate transfer body 70 is successively performed employing an electric field formed by primary transfer bias applied to intermediate transfer body 70 from primary transfer roller 5*a*.

The surface of photoreceptor 1 corresponding to intermediate transfer body 70, which has completed transfer of the yellow toner image as the first color, is cleaned by cleaning unit 6*a*.

In the same manner as above, a magenta toner image as the second color, a cyan toner image as the third color, and black toner image as the fourth color are successively transferred onto intermediate transfer body 70 being superposed, whereby an overlapped toner image corresponding to the targeted color image is formed.

Secondary transfer roller 5*b* is subjected to bearing in parallel to secondary transfer facing roller 79*b* and is so arranged that the bottom surface section of intermediate transfer body 70, can be withdrawn from the apparatus.

The primary transfer bias to achieve successive superposing transfer of toner images of the first-fourth colors onto intermediate transfer body 70 from photoreceptor 1 exhibits polarity which is reverse to that of the toner and is applied from a bias power source. The resulting applied voltage is, for example, in the range of +100 V to +2 kV.

During the primary transfer process of toner images of the first-third colors from photoreceptor 1 to intermediate transfer body 70, it is possible that secondary transfer roller 5*b* and intermediate transfer body cleaning means 6*b* retract from intermediate transfer body 70.

Transfer of the color toner image which has been transferred onto looped intermediate transfer body 70 and superposed thereon is transferred onto transfer material P as a second image carrier as follows. Secondary transfer roller 5*b* is brought into contact with the looped intermediate transfer body 70 and transfer material P is fed at specified timing to the contact nip of secondary transfer roller 5*b* with the looped belt of intermediate transfer body 70 through the transfer paper guide from paired paper feeding registration rollers 23. Secondary transfer bias is applied to second transfer roller 5*b* from a bias power source. By utilizing the resulting secondary transfer bias, the superposed color toner image is transferred (secondary transfer) onto transfer material P, which is the second image carrier, from intermediate transfer body 70. Transfer material P which has been subjected to transfer of toner images is conveyed to fixing means 24 and fixed while heated.

Image forming methods are applied to common electrophotographic apparatuses such as electrophotographic copiers, laser printers, LED printers, or liquid crystal shutter type printers. In addition, it is possible to widely apply the above methods to display, recording, shortrun printing and plate making to which electrophotographic techniques are applied, as well as apparatuses such as FAX machines.

EXAMPLES

The present invention will now be detailed with reference to examples.

Toner Production Example 1

Example of a Black Flat Toner

Added to 10.0 liters of pure water was 0.90 kg of sodium n-dodecylsulfate, and was subsequently dissolved. Gradually added to the resulting solution were 1.20 kg of REGAL 330R (carbon black manufactured by Cabot Corp.). The resulting mixture was suitably stirred for one hour, and thereafter, was continuously dispersed for 20 hours employing a sand grinder (a medium type homogenizer). The resulting dispersion was designated as "Colorant Dispersion 1". A solution comprised of 0.055 kg of sodium dodecylbenzenesulfonate and 4.0 liters of deionized eater was designated as "Anionic Surface Active Agent Solution A".

A solution comprised of 0.014 g of a nonylphenolpolyethylene oxide 10 mole addition product and 4.0 liters of deionized water was designated as "Nonionic Surface Active Agent Solution B". A solution prepared by dissolving 223.8 g of potassium persulfate in 12.0 liters of deionized water was designated as "Initiator Solution C".

Charged into a 100 liter GL (glass lined) reaction vessel fitted with a thermal sensor were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent A", and the total amount of "Nonionic Surface Active Agent Solution B", and the resulting mixture was stirred. Subsequently, 44.0 liters of deionized water were added.

When the resulting mixture reached 75° C., the total amount of "Initiator Solution C" was added. Thereafter, while maintaining the resulting mixture at 75±1° C., a mixture consisting of 12.1 kg of styrene, 2.70 kg of n-butyl acrylate, 1.14 kg of methacrylic acid, and 550 g of t-dodecylmercaptan was added dropwise. After said dropwise addition, the resulting mixture was heated to 80±1° C. and stirred for 6 hours while maintaining said temperature. Subsequently, the temperature was lowered to no more than 40° C. and stirring was stopped. The resulting products were filtered employing a pole filter and the resulting filtrate was designated as "Latex 1-A".

The resinous particles in said Latex 1-A exhibited a glass transition temperature of 57° C. and a softening point of 121° C., a weight average molecular weight of 12,700 regarding the molecular weight distribution, and a weight average particle diameter of 120 nm.

A solution prepared by dissolving 0.055 kg of sodium dodecylbenzenesulfonate in 4.0 liters of deionized water was designated as "Anionic Surface Active Agent Solution D".

A solution prepared by dissolving 0.014 kg of a nonylphenolpolyethylene oxide 10 mole addition product in 4.0 liters of deionized water was designated as "Nonionic Surface Active Agent Solution E".

A solution prepared by dissolving 200.7 g of potassium persulfate (manufactured by Kanto Kagaku) in 12.0 liters of deionized water was designated as "Initiator Solution F".

Charged into a 100 liter GL reaction vessel fitted with a thermal sensor, a cooling pipe, a nitrogen gas inlet, and a comb shaped baffle, were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent D", and the total amount of "Nonionic Surface Active Agent Solution E", and the resulting mixture was stirred.

Subsequently, 44.0 liters of deionized water were added. When the heated resulting mixture reached 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. After said dropwise addition, the resulting mixture was maintained at 72±2° C. and stirred for 6 hours while maintaining said temperature. Subsequently, the temperature was raised to 80±2° C., and stirring was carried out for 12 more hours while controlling the temperature within said range. The temperature was then lowered to no more than 40° C., and stirring was stopped. The resulting products were filtered employing a pole filter and the resulting filtrate was designated as "Latex 1-B".

The resinous particles in said Latex 1-B exhibited a glass transition temperature of 58° C. and a softening point of 132° C., a weight average molecular weight of 245,000 regarding the molecular weight distribution, and a weight average particle diameter of 110 nm.

A solution prepared by dissolving 5.36 g of sodium chloride as the salting-out agent in 20.0 liters of deionized water was designated as "Sodium Chloride Solution G".

A solution prepared by dissolving 1.00 g of a fluorine based nonionic surface active agent in 1.00 liter of deionized water was designated as "Nonionic Surface Active Agent Solution H".

Charged into a 100 liter SUS reaction vessel (the reaction apparatus having a crossed axes angle α of 25 degrees), fitted with a thermal sensor, a cooling pipe, a nitrogen gas inlet, a particle diameter and shape monitoring device, were 20.0 kg of Latex 1-A and 5.2 kg of Latex 1-B as prepared above, 0.4 kg of Colorant Dispersion 1, and 20.0 kg of deionized water, and the resulting mixture was stirred. Subsequently, the mixture was heated to 40° C., and said Sodium Chloride Solution G and 6.00 kg of isopropanol (manufactured by Kanto Kagaku), and said Nonionic Surface Active Agent Solution G were added in said order. Thereafter, the resulting mixture was put aside for 10 minutes, and then heated to 80° C. over a period of 60 minutes. While being heated at 80±2° C. for the period of from 0.5 to 5 hours while stirring, the mixture was subjected to salting-out/fusion so that the particle diameter increased. Subsequently, the growth of the particle diameter was terminated by the addition of 2.1 liters of pure water. Targeted volume average particle diameter was 3-8 mm. The resultant was named as "Fused particles dispersion".

Charged into a 5 liter reaction vessel, fitted with a thermal sensor, a cooling pipe, were 5.0 kg of the coalesced particle dispersion as prepared above, and said dispersion was heated at 85±2° C. for 4 hours. when the rate of polymerization reaches at 80%, particle flatting process was conducted wherein the liquid was supplied continuously to annular type continuous wet stirring mill (manufactured by Shinko Pantents Inc.), and was processed at 65° C., rotor circumference velocity of 15 m/min., and average retention time of 15 minutes. Thereafter, the resulting dispersion was poured into the reaction vessel, 0.03 kg of sodium dodecylbenzene sulfonate was added, and they were stirred with heating at 85±2° C. for 4 hours to terminate polymerization The resultant was cooled to no more than 40° C. and stirring was terminated. Subsequently, while employing a centrifuge, classification was carried out in the liquid medium utilizing a centrifugal sedimentation method, and filtration was carried out employing a 45 μm sieve. The resulting filtrate was designated as Coalesced Liquid. Subsequently, wet cake-like wet cake-like black flat particles 1 were collected from said Coalesced Liquid through filtration employing a Buchner's funnel, and then washed with deionized water.

The resulting wet cake-like black flat particles 1 were dried at an air intake temperature of 60° C., employing a flash jet dryer, and subsequently dried at 60° C. employing a fluidized layer dryer and Black flat particles 1 was obtained.

Externally added to 100 parts by weight of the obtained colored particles were 1 part by weight of fine silica particles and 0.1 part by weight of zinc stearate, and the resulting mixture was blended employing a Henschel mixer, whereby Black flat toner 1-B were obtained.

Toner Production Example 2

Yellow Flat Toner 1-Y

Yellow flat toner 1-Y was obtained by the same way as Toner Production Example 1 except that 1.05 kg of C.I. Pigment Yellow 17 was employed in place of the carbon black as a colorant.

Toner Production Example 3

Magenta Flat Toner 1-M magenta flat toner 1-M was obtained by the same way as Toner Production Example 1 except that 1.20 kg of C.I. Pigment Red 122 was employed in place of the carbon black as a colorant.

Toner Production Example 4

Cyan Flat Toner 1-C

Cyan flat toner 1-C was obtained by the same way as Toner Production Example 1 except that 0.60 kg of C.I. Pigment Blue 15:3 was employed in place of the carbon black as a colorant.

Toner Production Example 5

Black Flat Toner 2-B

Black flat toner 2-B was obtained by the same way as Toner Production Example 1 except that the condition of the annular type continuous wet stirring mill was applied as temperature at 70° C., rotor circumference velocity of 20 m/min., and average retention time of 15 minutes.

Toner Production Example 6

Yellow Flat Toner 2-Y

Yellow flat toner 2-Y was obtained by the same way as Toner Production Example 5 except that 1.05 kg of C.I. Pigment Yellow 17 was employed in place of the carbon black as a colorant.

Toner Production Example 7

Magenta Flat Toner 2-M magenta flat toner 2-M was obtained by the same way as Toner Production Example 5 except that 1.20 kg of C.I. Pigment Red 122 was employed in place of the carbon black as a colorant.

Toner Production Example 8

Cyan Flat Toner 2-C

Cyan flat toner 2-C was obtained by the same way as Toner Production Example 5 except that 0.60 kg of C.I. Pigment Blue 15:3 was employed in place of the carbon black as a colorant.

Toner Production Example 9

Black Flat Toner 3-B

Black flat toner 3-B was obtained by the same way as Toner Production Example 1 except that the condition of the annular type continuous wet stirring mill was applied as temperature at 68° C., rotor circumference velocity of 17 m/min., and average retention time of 14 minutes.

Toner Production Example 10

Yellow Flat Toner 3-Y

Yellow flat toner 3-Y was obtained by the same way as Toner Production Example 9 except that 1.05 kg of C.I. Pigment Yellow 17 was employed in place of the carbon black as a colorant.

Toner Production Example 11

Magenta Flat Toner 3-M magenta flat toner 3-M was obtained by the same way as Toner Production Example 9 except that 1.20 kg of C.I. Pigment Red 122 was employed in place of the carbon black as a colorant.

Toner Production Example 12

Cyan Flat Toner 3-C

Cyan flat toner 3-C was obtained by the same way as Toner Production Example 9 except that 0.60 kg of C.I. Pigment Blue 15:3 was employed in place of the carbon black as a colorant.

Toner Production Example 13

Black Flat Toner 4-B

Black flat toner 4-B was obtained by the same way as Toner Production Example 1 except that the condition of the annular type continuous wet stirring mill was applied as temperature at 50° C., rotor circumference velocity of 5 m/min., and average retention time of 5 minutes.

Toner Production Example 14

Yellow Flat Toner 4-Y

Yellow flat toner 4-Y was obtained by the same way as Toner Production Example 13 except that 1.05 kg of C.I. Pigment Yellow 17 was employed in place of the carbon black as a colorant.

Toner Production Example 15

Magenta Flat Toner 4-M magenta flat toner 4-M was obtained by the same way as Toner Production Example 13 except that 1.20 kg of C.I. Pigment Red 122 was employed in place of the carbon black as a colorant.

Toner Production Example 16

Cyan Flat Toner 4-C

Cyan flat toner 4-C was obtained by the same way as Toner Production Example 13 except that 0.60 kg of C.I. Pigment Blue 15:3 was employed in place of the carbon black as a colorant.

Toner Production Example 17

Black Flat Toner 5-B

Black flat toner 5-B was obtained by classifying Black flat toner 1-B so as to have specification shown in Table 1.

Toner Production Example 18

Yellow Flat Toner 5-Y

Yellow flat toner 5-Y was obtained by the same way as Toner Production Example 17 except that 1.05 kg of C.I. Pigment Yellow 17 was employed in place of the carbon black as a colorant.

Toner Production Example 19

Magenta Flat Toner 5-M magenta flat toner 5-M was obtained by the same way as Toner Production Example 17 except that 1.20 kg of C.I. Pigment Red 122 was employed in place of the carbon black as a colorant.

Toner Production Example 20

Cyan Flat Toner 5-C

Cyan flat toner 5-C was obtained by the same way as Toner Production Example 17 except that 0.60 kg of C.I. Pigment Blue 15:3 was employed in place of the carbon black as a colorant.

Toner Production Example 21

Black flat toner 6-B

Black flat toner 6-B was obtained by classifying Black flat toner 1-B so as to have specification shown in Table 1.

Toner Production Example 22

Yellow Flat Toner 6-Y

Yellow flat toner 6-Y was obtained by the same way as Toner Production Example 21 except that 1.05 kg of C.I. Pigment Yellow 17 was employed in place of the carbon black as a colorant.

Toner Production Example 23

Magenta Flat Toner 6-M magenta flat toner 6-M was obtained by the same way as Toner Production Example 21 except that 1.20 kg of C.I. Pigment Red 122 was employed in place of the carbon black as a colorant.

Production Example 24

Cyan flat toner 6-C

Cyan flat toner 6-C was obtained by the same way as Toner Production Example 21 except that 0.60 kg of C.I. Pigment Blue 15:3 was employed in place of the carbon black as a colorant.

Condition of flatting process of each of Examples 1-16 are shown in Table 1.

Average thickness (t) and circle equivalent diameter (d) were measured by a method mentioned above.

TABLE 1

| Toner Production No. | Toner No. | Processing Temperature (° C.) | Rotor Peripheral Rate m/min | Average Retention Time (min) | Thickness t of Flattened Toner Particle (μm) | Circle equivalent Diameter d (μm) | d/t |
|---|---|---|---|---|---|---|---|
| 1 | 1-B | 65 | 15 | 13 | 2.0 | 6.3 | 3.2 |
| 2 | 1-Y | 65 | 15 | 13 | 2.0 | 6.1 | 3.1 |
| 3 | 1-M | 65 | 15 | 13 | 2.0 | 6.5 | 3.3 |

TABLE 1-continued

| Toner Production No. | Toner No. | Processing Temperature (° C.) | Rotor Peripheral Rate m/min | Average Retention Time (min) | Thickness t of Flattened Toner Particle (μm) | Circle equivalent Diameter d (μm) | d/t |
|---|---|---|---|---|---|---|---|
| 4 | 1-C | 65 | 15 | 13 | 1.7 | 5.9 | 3.4 |
| 5 | 2-B | 70 | 20 | 15 | 1.2 | 6.5 | 5.4 |
| 6 | 2-Y | 70 | 20 | 15 | 1.2 | 6.1 | 5.3 |
| 7 | 2-M | 70 | 20 | 15 | 1.2 | 6.4 | 5.5 |
| 8 | 2-C | 70 | 20 | 15 | 1.2 | 6.0 | 5.2 |
| 9 | 3-B | 68 | 17 | 17 | 1.2 | 5.5 | 4.8 |
| 10 | 3-Y | 68 | 17 | 17 | 1.1 | 5.2 | 4.9 |
| 11 | 3-M | 68 | 17 | 17 | 1.2 | 5.7 | 4.6 |
| 12 | 3-C | 68 | 17 | 17 | 1.1 | 5.1 | 4.7 |
| 13 | 4-B | 50 | 5 | 5 | 3.6 | 6.1 | 1.7 |
| 14 | 4-Y | 50 | 5 | 5 | 3.9 | 5.9 | 1.5 |
| 15 | 4-M | 50 | 5 | 5 | 4.6 | 6.4 | 1.4 |
| 16 | 4-C | 50 | 5 | 5 | 3.4 | 6.1 | 1.8 |
| 17 | 5-B | 65 | 15 | 13 | 1.2 | 2.8 | 2.3 |
| 18 | 5-Y | 65 | 15 | 13 | 1.0 | 2.5 | 2.5 |
| 19 | 5-M | 65 | 15 | 13 | 1.2 | 2.9 | 2.4 |
| 20 | 5-C | 65 | 15 | 13 | 1.3 | 2.7 | 2.1 |
| 21 | 6-B | 65 | 15 | 13 | 2.0 | 8.3 | 4.1 |
| 22 | 6-Y | 65 | 15 | 13 | 2.1 | 8.5 | 4.0 |
| 23 | 6-M | 65 | 15 | 13 | 2.2 | 8.6 | 3.9 |
| 24 | 6-C | 65 | 15 | 13 | 2.2 | 8.9 | 4.0 |

Each of toners 1 to 24 was mixed with carrier having a ferrite core particles with 65 μm average particle diameter coated with silicone resin, in a ratio of toner/carrier equal 50 g/950 g.

Subsequently, photoreceptors used in examples were prepared.

A conductive aluminum substrate was machined to surface roughness Rz of 0.3 μm. After washing and drying the resulting substrate, liquid compositions were successively applied onto the surface, whereby a photoreceptor was prepared.

Photoreceptor 1

<Interlayer 1> (UCL-1)

| | |
|---|---|
| Alkyd resin BEKKORITE M-6401 (solids 50% by weight) (produced by Dainippon Ink and Chemicals Inc.) | 150 weight parts |
| Melamine resin SUPER BEKKAMINE G-821-60 (solids 50% by weight) (produced by Dainippon Ink and Chemicals Inc.) | 100 weight parts |
| Methyl ethyl ketone | 500 weight parts |
| Titanium oxide (at a number average diameter of the primary particles of 50 nm) | 450 weight parts |

A liquid composition was prepared employing the above compounds and was dispersed for 36 hours employing a ball mill in which alumina balls were employed as media, whereby an interlayer liquid coating composition was prepared. The resulting interlayer liquid coating composition was applied onto an aluminum cylinder and subsequently dried at 140° C. for 20 minutes, whereby a 3.0 μm thick interlayer was formed.

<Charge Generating Layer> (CGL)

| | |
|---|---|
| Butyral resin ESLEX BMS (manufactured by Sekisui Chemical Co., Ltd.) | 5 weight parts |
| Cyclohexanone | 200 weight parts |
| Y-type titanyl phthalocyanine (CGM-1) | 20 weight parts |

A liquid composition was prepared employing the above compounds and was dispersed for 72 hours employing a ball mill. Thereafter, 210 parts by weight of cyclohexanone were added and the resulting mixture was dispersed for 5 hours. While stirring, the resulting dispersion was diluted by a mixture of cyclohexanone/methyl ethyl ketone=2/1 so that the resulting solid concentration reached 2.0 percent by weight. The charge generating layer liquid coating composition, prepared as above, was applied onto the interlayer, employing a dip coating method and subsequently dried at 130° C. for 20 minutes, whereby an approximately 0.2 μm thick charge generating layer was formed.

<Charge Transport Layer> (CTL)

| | |
|---|---|
| Charge transport material [4-(2,2-diphenylvinyl) phenyl] -di-p tolylamine | 80 weight parts |
| Polycarbonate resin PANLITE TS2050 (produced by Tejin Chemicals Ltd.) | 100 weight parts |
| IONET DS-300 produced by Sanyo Chemical Industries, Ltd. | 1.0 weight part |
| Silicone oil KF-50 (produced by Shin-Etsu Chemical Co., Ltd.) | 0.02 weight parts |
| Tetraydrofuran | 770 weight parts |
| Alumina (at a particle diameter of 50 nm) | 5 weight parts |

The above components are mixed, whereby a charge transport layer liquid coating composition was prepared. The above liquid coating composition was applied onto charge generating layer CGL, subsequently dried at 135° C. for 20 minutes to prepare a 25 μm thick charge transport layer, whereby Photoreceptor 1 was prepared.

Photoreceptor 2

Photoreceptor 2 was prepared in the same manner as Photoreceptor 1, except that an OCL composition was applied onto the CTL which was applied using the CTL composition of Photoreceptor 1 from which aluminum was omitted.

<Protective Layer 1> (OCL-1)

| | |
|---|---|
| Charge transport material [4-(2,2-diphenylvinyl) phenyl]-di-p tolylamine | 8 weight parts |
| Polycarbonate (BPZ: viscosity average molecular weight of 50,000) | 10 weight parts |
| Tetrahydrofuran | 100 weight parts |

-continued

| | |
|---|---|
| Alumina (at a particle diameter of 50 nm, subjected to a methyl hydrogen polysiloxane treatment, 5% treatment) | 1 weight part |

The above components were mixed and a protective layer liquid coating composition was prepared. The resulting coating composition was applied onto the charge transport layer, and subsequently dried at 130° C. for 20 minutes to form a 5 μm thick protective layer, whereby a photoreceptor was prepared. The resulting photoreceptor was designated as Photoreceptor 2.

Photoreceptors 3-5

Photoreceptors 3-5 were prepared in the same manner as Photoreceptor 2, except that alumina on the protective layer of Photoreceptor 2 was varied to inorganic particles and particle diameter of Table 2.

Photoreceptor 6

Photoreceptor 6 was prepared in the same manner as Photoreceptor 1, except that alumina in the charge transport layer of Photoreceptor 1 was omitted.

The structural formula of polycarbonate (BPZ) is shown below.

PC-Z (BPZ)

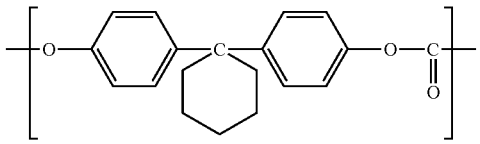

Evaluation 1 (Evaluation for the Counter-Development system)

The prepared developers and photoreceptors were combined (Combination Nos. 1-10) and each combination was loaded into FULL COLOR COMPOSITE MACHINE 8050 (produced by Konica Minolta Business Technologies, Inc.) modified (being a tandem system FULL COLOR COMPOSITE MACHINE 8050 (at a processing rate of 220 mm/second) was modified to a counter-development system), and evaluation of produced color images was performed. Original images including a white background section, a solid image section, a halftone image section, and a text image section were continuously copied on A4 paper sheets and evaluation was performed. In more detail, 300,000 sheets were copied and copies for image evaluation were picked up at the beginning and every 5,000th sheet. Evaluation items and evaluation criteria are described below.

Evaluation Conditions

Linear rate of photoreceptor: 220 mm/second

Linear rate of developing sleeve: 400 mm/second

Magnetic brush bent depth (Bsd); 0.30 mm

Developing gap (Dsd); 0.28 mm

Alternate-current component of developing bias (Vac): 1.0 KVp-p

Peripheral speed ratio of a developing sleeve and a photoreceptor (Vs/Vopc): 1.8

Direct-current component of developing bias (Vdc): −500 V

Difference between the surface potential V0 of photoreceptor and the direct-current component Vdc of developing bias (|V0−Vdc|): 200 V Frequency: 3 kHz and 9 kHz Duty ratio: 50% in a rectangular wave (1) Image Evaluation Image Density Relative density of the copied image at the beginning and the 300,000th was determined employing densitometer, "RD-918" (produced by Macbeth Co.), while the density of the printing sheet of paper was 0.0.

A: at least 1.3/good

B: 1.0-1.3/level resulting in no problems for commercial use

C: less than 1.0/resulting

Fog

Fog density of the first and 300,000th prints was determined employing densitometer "RD-919" (produced by Macbeth Co.) in terms of relative density in which the reflection density of a A4 sheet was 0.000.

A: less than 0.010 (excellent)

B: 0.010-0.020 (a level resulting in no problem for commercial use

C: at least 0.020

Decrease in Density in the Leading Edge Portion

As the 300,000th print, a halftone image was printed and evaluated.

A: no decrease in density in the leading edge portion was noted and the halftones image was clearly reproduced (excellent)

B: even though the halftone image was clearly reproduced, the leading edge portion resulted in a decrease in at most 0.04 in terms of reflection density (no problems for commercial use)

C: the leading edge portion resulted in a decrease of at least 0.04 in terms of reflection density of the halftone image Toner Scattering A: toner scattering was minimal and sharpness of text images was good (good)

B: toner scattering was slight, and characters up to 3-point were readable (commercially viable)

C: toner scattering was appreciable and 3-point characters were partly not readable Color Reproduction The color of solid image portion of secondary colors (red, blue, and green) in each of the Y, M, and C toners of the image of the first sheet and 100th sheet was determined employing "Macbeth Color-EYE 7000", and the color difference between the first and 100th of each of the solid images was calculated employing CMC (2:1) color difference formula.

A: color difference was at most 3 (good)

B: color difference was at least 3 (resulting in problems for commercial use, commercially unviable)

Table 2 shows the results.

TABLE 2

| | | Surface Layer of Photoreceptor | | | | Image Evaluation | | | | |
|---|---|---|---|---|---|---|---|---|---|---|
| Combination No. | Photoreceptor No. | Surface Layer | Inorganic Particles in Surface Layer | Diameter of Inorganic Particles (nm) | Toner No. | Image Density | Fog | Decrease in Density of Leading Edge Portion | Toner Scattering | Color Reproduction |
| 1 | 1 | CTL | non-treated alumina | 50 | 1-B to 1-C | A | A | B | B | A |
| 2 | 2 | OCL | alumina treated with methyl hydrogen polysiloxane | 50 | 1-B to 1-C | A | A | A | A | A |
| 3 | 3 | OCL | silica treated with methyl hydrogen polysiloxane | 35 | 3-B to 3-C | B | A | A | B | A |
| 4 | 4 | OCL | titania treated with methyl hydrogen polysiloxane | 140 | 1-B to 1-C | A | A | A | A | A |
| 5 | 5 | OCL | silica treated with methyl hydrogen polysiloxane | 10 | 1-B to 1-C | A | A | A | A | A |
| 6 | 2 | OCL | alumina treated with methyl hydrogen polysiloxane | 50 | 2-B to 2-C | B | B | B | D | D |
| 7 | 2 | OCL | alumina treated with methyl hydrogen polysiloxane | 50 | 4-B to 4-C | D | B | D | D | D |
| 8 | 2 | OCL | alumina treated with methyl hydrogen polysiloxane | 50 | 5-B to 5-C | B | B | D | D | D |
| 9 | 2 | OCL | alumina treated with methyl hydrogen polysiloxane | 50 | 6-B to 6-C | D | B | B | B | A |
| 10 | 6 | CTL | — | — | 1-B to 1-C | B | B | D | D | D |

As can be clearly seen from Table 2, in the evaluation of images prepared employing the counter-development system, Combination Nos. 1-5 in which the surface layer of the organic photoreceptor incorporated inorganic particles was combined with flat toner particles of circle equivalent diameter d of 3.0-8.0 μm and ratio (d/t, flatness) of d to toner particle average thickness of 2.0-5.0, exhibited excellent characteristics for all the evaluation items such as image density, fog, decrease in density of the leading edge portion, toner scattering and color reproduction. On the other hand, when toner particles of a d/t (flatness) of at least 5.0 were used as shown in Combination No. 6, toner scattering occurred and color reproduction was degraded. Further, when toner particles of a d/t (flatness) of at most 2.0 were employed as shown in Combination No. 7, toner scattering occurred, image density was not sufficiently high, decrease in density of the leading edge portion occurred, and color reproduction was degraded. Still further, when toner particles of volume average particle diameter d of at most 3.0 were employed as shown in Combination No. 8, toner scattering increased, decrease in density of the leading edge portion occurred, and color reproduction was degraded. Yet further, when toner particles of volume average particle diameter d of at least 8.0 as shown in Combination No. 9, image density was not sufficiently high. Still further, when a photoreceptor, which did not incorporate inorganic particles, was used as shown Combination No. 10, a decrease in density of the leading edge portion as well as toner scattering occurred, and color reproduction was degraded.

Evaluation 2 (Evaluation of the Parallel Development System)

The parallel development system, in which the developing sleeve was forwarded in parallel to the direction of the photoreceptor, was evaluated in the same manner as Evaluation 1. As a result, the difference between the present invention of Evaluation 1 and the comparative examples not clearly noted.

Evaluation Conditions

Linear rate of photoreceptor: 220 mm/second

Linear rate of developing sleeve: 400 mm/second

As a result, as shown in Table 3, no difference between the present invention and comparative examples was not apparent, and in entire present inventive and comparative examples, electrophotographic images which resulted in decrease in image density were obtained, compared to the counter-development system.

TABLE 3

| | Image Evaluation | | | | |
|---|---|---|---|---|---|
| Combination No. | Image Density | Fog | Decrease in Density of Leading Edge Portion | Toner Scattering | Color Reproduction |
| 1 | B | A | A | B | B |
| 2 | B | A | A | A | B |
| 3 | B | A | A | B | B |
| 4 | B | A | A | A | B |
| 5 | B | A | A | A | B |
| 6 | B | A | A | B | B |
| 7 | B | A | A | B | B |
| 8 | B | A | A | B | B |
| 9 | B | A | A | B | B |
| 10 | B | A | A | B | B |

The invention claimed is:

1. An image forming method comprising:

forming an electrostatic latent image on an organic photoreceptor, and developing the electrostatic latent image by a developing device containing a developing sleeve and developer containing toner, to form a toner image on the photoreceptor, wherein the photoreceptor contains inorganic particles in a surface layer, the toner has circle equivalent diameter d of 3.0 to 8.0 μm viewed from a direction which maximizes the projective area of toner particles, the toner has a flatness ratio d/t of 2.0 to 5.0, wherein d is the circle equivalent diameter and t is an average thickness of toner particles, and the electrostatic latent image is developed in such a manner that the developing sleeve is rotated in an opposite direction with respect to a rotation direction of the photoreceptor.

2. The image forming method of claim 1, wherein an average primary diameter of the inorganic particles is 3 to 150 nm.

3. The image forming method of claim 1, wherein the inorganic particles are metal oxides.

4. The image forming method of claim 1, wherein the inorganic particles include at least one of silica, alumina, and titania.

5. The image forming method of claim 1, wherein the inorganic particles are subjected to a surface treatment.

6. The image forming method of claim 1, wherein the photoreceptor comprises a conductive substrate having thereon at least a charge generating layer and a charge transport layer.

7. The image forming method of claim 1, wherein a surface layer of the photoreceptor comprises an antioxidant.

8. The image forming method of claim 1, wherein the toner is prepared by that a polymerization toner is subjected to a flattening treatment.

9. The image forming method of claim 1, wherein the toner has the circle equivalent diameter d of 3.5 to 7.0 μm.

10. The image forming method of claim 1, wherein the toner has the flatness ratio d/t of 2.2 to 4.5.

11. The image forming method of claim 1, wherein the toner image formed on the photoreceptor is transferred onto a recording member.

12. The image forming method of claim 1, wherein developing gap (OSd) between the photoreceptor and the developing sleeve is 0.2 to 0.6 mm.

13. The image forming method of claim 1, wherein a bent depth (Bsd) of a magnetic brush at a developing region between the photoreceptor and the developing sleeve is 0 to 0.8 mm.

14. The image forming method of claim 1, wherein the peripheral speed ratio (Vs/Vopc) of the developing sleeve (Vs) and the photoreceptor (Vopc) is 1.2 to 3.0.

15. The image forming method of claim 1, wherein a difference |Vo−Vdc| between a surface electric potential Vo of the photoreceptor and a direct-current component Vdc of a developing bias is 100 to 300 V, a direct-current component Vdc of a developing bias is −300 V to −650 V, an alternate current component Vac of the developing bias is 0.5 to 1.5 KV, a frequency is 3 to 9 KHz, a duty ratio is made 45 to 70% (the time ratio of the developing side in a rectangular wave), and a shape of the alternate current component is a rectangular wave.

16. An image forming method comprising:

rotating a first organic photoreceptor;

rotating a first developing sleeve in an opposite direction with respect to a rotation direction of the first photoreceptor;

forming a first toner image having a first color on the first photoreceptor by a first developer containing a first toner by bringing the first developer into contact with the first photoreceptor;

rotating a second organic photoreceptor;

rotating a second developing sleeve in the opposite direction with respect to a rotation direction of the second photoreceptor; and forming a second toner image having a second color on the second photoreceptor by developing a second developer containing a second toner by bringing the second developer into contact with the second photoreceptor, wherein each of the first and second photoreceptors comprises a surface layer including inorganic particles, each of the first and second toners has a circle equivalent diameter d in the range of 3.0-8.0 μm when viewed from a direction which maximizes a projective area of toner particles, and a flatness ratio d/t of 2.0-5.0, wherein d is the circle equivalent diameter and t is an average thickness of the toner particles.

17. The image forming method of claim 16, further comprising transferring the first and second toner images on each of the photoreceptors to a recording member directly or via an intermediate transfer member.

18. An image forming method for use in an image forming apparatus comprising an organic photoreceptor and a plurality of image forming units wherein each of the image forming units includes a developing device having a developing sleeve, the developing sleeve carries a developer comprising a toner, the method comprising:

rotating the photoreceptor;

rotating the developing sleeve in an opposite direction with respect to a rotation direction of the photoreceptor;

forming an electrostatic latent image on the photoreceptor; and developing the electrostatic latent image by the developer to visualize the electrostatic latent image into a toner image with bringing the developer into contact with the photoreceptor, wherein each of the toner images formed by using each of the image forming units has a different color than each other, the photoreceptor comprises a surface layer including inorganic particles, the toner has a circle equivalent diameter d of 3.0-8.0 μm when viewed from the direction which maximizes the projective area of toner particles, and a a flatness ratio d/t of 2.0-5.0, wherein d is the circle equivalent diameter and t is an average thickness of the toner particles.

19. The image forming method of claim 1, wherein the inorganic particles include at least one of silica, alumina, and titania, the photoreceptor comprises conductive substrate having thereon at least a charge generating layer and a charge transport layer, the toner has the circle equivalent diameter d of 3.5 to 7.0 μm, and the toner has a flatness ratio d/t of 2.2 to 4.5.

20. The image forming method of claim 16, wherein the inorganic particles include at least one of silica, alumina, and titania, the photoreceptor comprises conductive substrate having thereon at least a charge generating layer and a charge transport layer, the toner has the circle equivalent diameter d of 3.5 to 7.0 μm, and the toner has the flatness ratio d/t of 2.2 to 4.5.

* * * * *